US008791937B2

(12) United States Patent
Chung

(10) Patent No.: US 8,791,937 B2
(45) Date of Patent: Jul. 29, 2014

(54) OVER-DRIVABLE OUTPUT BUFFER, SOURCE DRIVER CIRCUIT HAVING THE SAME, AND METHODS THEREFOR

(75) Inventor: Kyu-young Chung, Cheongju-si (KR)

(73) Assignee: Magnachip Semiconductor Ltd., Cheongju-si (KR)

( * ) Notice: Subject to any disclaimer, the term of this patent is extended or adjusted under 35 U.S.C. 154(b) by 286 days.

(21) Appl. No.: 13/187,605

(22) Filed: Jul. 21, 2011

(65) Prior Publication Data

US 2012/0026152 A1 Feb. 2, 2012

(30) Foreign Application Priority Data

Jul. 30, 2010 (KR) ..... 10-2010-0074159

(51) Int. Cl.
*G09G 3/00* (2006.01)
*G09G 3/36* (2006.01)

(52) U.S. Cl.
CPC ..... *G09G 3/3688* (2013.01); *G09G 2340/16* (2013.01); *G06G 2310/0291* (2013.01); *G09G 2320/0252* (2013.01)
USPC ..... 345/212; 345/211

(58) Field of Classification Search
USPC ..... 326/82; 327/536; 330/9; 341/144; 345/87, 89, 92, 96, 98, 100, 204, 211, 345/212
See application file for complete search history.

(56) References Cited

U.S. PATENT DOCUMENTS 6,144,374 A * 11/2000 Hyun ..... 345/204
6,707,442 B2 * 3/2004 Watanabe ..... 345/100
7,317,440 B2 * 1/2008 Chung ..... 345/89
2007/0020791 A1 1/2007 Hsu et al.
2008/0042689 A1 2/2008 Yen

FOREIGN PATENT DOCUMENTS

JP 2008-46578 2/2008

OTHER PUBLICATIONS

Office Action issued by the Korean Intellectual Property Office on Nov. 23, 2011 for Korean Patent Application No. 10-2010-0074159 which was filed on Jul. 30, 2010.

* cited by examiner

*Primary Examiner* — Dwayne Bost
*Assistant Examiner* — Sepehr Azari
(74) *Attorney, Agent, or Firm* — NSIP Law

(57) ABSTRACT

Provided is an output buffer for a source driver circuit which receives an external buffer input signal and generates a buffer output signal having a predetermined target voltage, the output buffer including: an over-driving controller configured to generate a pair of first internal buffer input signals and a pair of second internal buffer input signals for an over-driving operation, based on a first over-driver enable signal and a second over-driver enable signal, the first and second over-driver signals being provided from an external source, and an output buffer unit configured to: perform the over-driving operation, based on the pair of first internal buffer input signals and the pair of second internal buffer input signals provided from the over-driving controller, and generate: a buffer output signal including a target voltage greater than the predetermined target voltage, or a buffer output signal including a target voltage less than the predetermined target voltage.

47 Claims, 16 Drawing Sheets

OVER-DRIVABLE OUTPUT BUFFER, SOURCE DRIVER CIRCUIT HAVING THE SAME, AND METHODS THEREFOR

CROSS-REFERENCE TO RELATED APPLICATION(S)

This application claims the benefit under 35 U.S.C. §119 (a) of Korean Patent Application No. 10-2010-0074159, filed on Jul. 30, 2010, in the Korean Intellectual Property Office, the entire disclosure of which is incorporated herein by reference for all purposes.

BACKGROUND

1. Field

The following description relates to an over-drivable output buffer, a source driver circuit having the same, and methods thereof, and more particularly, to an output buffer which is able to provide an output signal over-driven greater than or less than a target voltage to a display panel, a source driver circuit having the same, and methods for an output buffer and source driver circuit.

2. Description of Related Art

In general, a flat panel display apparatus includes a display panel on which a plurality of unit pixels for displaying an image are arranged, a gate driver circuit to drive gate lines of the display panel, and a source driver circuit to provide display data, to data lines of the display panel and display the data as an image. If display data of a predetermined bit is provided to the source driver circuit, the source driver circuit provides an output signal having a predetermined target value to drive the unit pixels to the display panel within one horizontal period (1H), such that the image is displayed on the display panel.

As the size of display panels increases and display definition increases, a target voltage of the output signal, which is provided to the display panel by the source driver circuit, increases. In other words, as the size of the display panel increases and the display definition increases, a load resistance and a capacitance of a load capacitor connected to an output terminal of the source driver circuit increase, and accordingly the target voltage of the output signal increases.

Therefore, due to the increased capacity of the output load caused by the increased size and definition of the display panel, a resistance-capacitive (RC) delay of the output load becomes larger than a slew rate of the output buffer of the source driver circuit. The slew rate is the maximum rate of change of a signal at any point in a circuit. Therefore, even if the output signal of the target voltage provided from the output buffer is provided to the unit pixels of the display panel, the pixel load of each unit pixel is not able to reach a desired target value within a desired time. In other words, in the case in which the load resistance and the load capacitance of the source driver, used in a display element having a large panel and a high definition, are great and the 1H is relatively small, the RC delay is so large that the unit pixels cannot reach the voltage of a desired target value within a desired time, even if the slew rate of the output buffer is high. Therefore, a desired image may not be displayed on the display panel.

SUMMARY

In one general aspect, there is provided an output buffer for a source driver circuit which receives an external buffer input signal and generates a buffer output signal including a predetermined target voltage, the output buffer including: an over-driving controller configured to generate a pair of first internal buffer input signals and a pair of second internal buffer input signals for an over-driving operation, based on a first over-driver enable signal and a second over-driver enable signal, the first and second over driver signals being provided from an external source, and an output buffer unit configured to: perform the over-driving operation, based on the pair of first internal buffer input signals and the pair of second internal buffer input signals provided from the over-driving controller, and generate: a buffer output signal including a target voltage greater than the predetermined target voltage, or a buffer output signal including a target voltage less than the predetermined target voltage.

In the output buffer, the over-driving controller may include: a first controller configured to: receive the external buffer input signal as a first input signal and the buffer output signal as a second input signal, differentially amplify the first and the second input signals, based on the first and the second over-driver enable signals, and output the pair of first internal buffer input signals to the output buffer unit, and a second controller configured to: receive the external buffer input signal as a first input signal and the buffer output signal as a second input signal, differentially amplify the first and the second input signals based on the first and the second over-driver enable signals, and output the pair of second internal buffer input signals to the output buffer unit.

In the output buffer, the first controller may include: a pair of first transistors configured to: receive the first input signal through a gate, and output one of the pair of first internal buffer input signals to a drain, and a pair of second transistors configured to: receive the second input signal through a gate, and output the other one of the pair of first internal buffer input signals to a drain.

In the output buffer, the pairs of first and second transistors may respectively include pairs of NMOS transistors.

In the output buffer, the first controller further may include: a first switch connected to one of the pair of first transistors in series, the first switch configured to be controlled by the second over-driver enable signal, and a second switch connected to one of the pair of second transistors in series, the second switch configured to be controlled by the first over-driver enable signal.

In the output buffer, the second controller may include: a pair of third transistors configured to: receive the second input signal through a gate, and output one of the pair of second internal buffer input signals to a drain, and a pair of fourth transistors configured to: receive the first input signal through a gate, and output the other one of the pair of second internal buffer input signals to a drain.

In the output buffer, the pairs of third and fourth transistors may respectively include pairs of PMOS transistors.

In the output buffer, the second controller may include: a third switch connected to one of the pair of third transistors in series, the third switch configured to be controlled by the second over-driver enable signal, and a fourth switch connected to one of the pair of fourth transistors in series, the fourth switch configured to be controlled by the first over-driver enable signal.

In the output buffer, in response to the first over-driver enable signal being enabled: the first switch may be short-circuited and the second switch may be open-circuited, such that a size of the pair of first transistors is smaller than a size of the pair of second transistors, the third switch may be short-circuited and the fourth switch may be open-circuited, such that a size of the pair of third transistors is smaller than a size of the pair of fourth transistors, and the over-driving controller may be further configured to provide the pairs of first and second internal buffer input signals for an ascending over-driving operation to the output buffer unit.

In the output buffer, in response to the second over-driver enable signal being enabled: the first switch may be open-circuited and the second switch may be short-circuited, such that a size of the pair of first transistors is larger than a size of the pair of second transistors, the third switch may be open-circuited and the fourth switch may be short-circuited, such that a size of the pair of third transistors is lager than a size of the pair of fourth transistors, and the over-driving controller may be further configured to provide the pairs of first and second internal buffer input signals for a descending over-driving operation to the output buffer unit.

In the output buffer, in response to the first and the second over driver enable signals being disabled: the first and the second switches may be short-circuited, such that a size of the pair of first transistors is a same as a size of the pair of second transistors, the third and the fourth switches may be short-circuited, such that a size of the pair of third transistors is a same as a size of the pair of fourth transistors, and the over-driving controller may be further configured to provide the pairs of first and second internal buffer input signals for a normal driving operation to the output buffer unit.

In the output buffer: the first over-driver enable signal may include an ascending over-driver enable signal, and the second over-driver enable signal may include a descending over-driver enable signal.

In another general aspect, there is provided a source driver circuit for driving a display panel including a plurality of scan lines, the source driver circuit including: an output buffer configured to: receive current data to be displayed on a current scan line of the plurality of scan lines as an external buffer input signal, and provide a buffer output signal including a predetermined target voltage to the display panel, and a data comparator configured to: compare the current data and previous data displayed on a previous scan line of the current scan line, and output first and second control signals to the output buffer, such that the output buffer is further configured to generate: a buffer output signal including a target voltage greater than the predetermined target voltage, or a buffer output signal including a target voltage less than the predetermined target voltage.

In the source driver circuit: the first control signal may include an ascending over-driver enable signal, and the second control signal may be a descending over-driver enable signal.

In the source driver circuit, the data comparator may be further configured to: generate the first control signal, in response to the current data being greater than the previous data by an over-driving threshold voltage, and generate the second control signal, in response to the current data being less than the previous data by the over-driving threshold voltage.

The source driver circuit may further include an over-driving enable unit configured to enable the first and the second control signals output from the data comparator only in an over-driving on period.

In the source driver circuit, the over-driving enable unit may include: a first AND gate configured to: receive the first control signal from the data comparator and an over-driving on signal from an external source, as two inputs, and enable the first control signal during only the over-driving on period, and a second AND gate configured to: receive the second control signal from the data comparator and the over-driving on signal, as two inputs, and enable the second control signal during only the over-driving on period.

In the source driver circuit, the output buffer may include: an over-driving controller configured to: differentially amplify the external buffer input signal and the buffer output signal, based on the first and the second control signals provided from the data comparator, and generate a pair of first internal buffer input signals and a pair of second internal buffer input signals for an over-driving operation, and an output buffer unit configured to: perform the over-driving operation, based on the pairs of first and second internal buffer input signals, and generate: a buffer output signal including a target voltage greater than the predetermined target voltage, or a buffer output signal including a target voltage less than the predetermined target voltage.

In the source driver circuit, the over-driving controller may include: a pair of first differential transistors configured to: receive the external buffer input signal through each respective gate, and output one of the pair of first internal buffer input signals to the output buffer unit through a drain, a pair of second differential transistors configured to: receive the buffer output signal through each respective gate, and output another of the pair of first internal buffer input signals to the output buffer unit through a drain, a pair of third differential transistors configured to: receive the external buffer input signal through each respective gate, and output one of the pair of second internal buffer input signals to the output buffer unit through a drain, a pair of fourth differential transistors configured to: receive the buffer output signal through each respective gate, and output another of the pair of second internal buffer input signals to the output buffer unit through a drain, a pair of first switches respectively connected to one of the pair of first differential transistors and one of the pair of second differential transistors in series, the pair of first switches configured to be respectively controlled by the first and the second control signals, and a pair of second switches respectively connected to one of the pair of third differential transistors and one of the pair of fourth differential transistors in series, the pair of second switches configured to be respectively controlled by the first and the second control signals.

In the source driver circuit, in response to the source driver circuit including a plurality of channels: the output buffer may be provided in each of the plurality of channels, and the comparator may be provided in each of the plurality of channels or is configured to be shared by the plurality of channels.

In another general aspect, there is provided a source driver circuit for driving a display panel including a plurality of scan lines, the source driver circuit including: a latch configured to store: current data to be displayed on a current scan line of the plurality of scan lines, and previous data displayed on a previous scan line of the current scan line, a data comparator configured to: compare the current data and the previous data provided from the latch, and generate an ascending over-driver enable signal or a descending over-driver enable signal, in response to the current data being greater than or less than the previous data by an over-driving threshold data, and an output buffer configured to: perform an over-driving operation based on the ascending or descending over driver enable signal, and provide: a buffer output signal including a target voltage greater than a predetermined target voltage with respect to the current data, which is an external buffer input signal, or a buffer output signal including a target voltage less than the predetermined target voltage to the display panel.

In the source driver circuit, the latch may include: a first latch unit configured to store the current data, and a second latch unit configured to store the previous data.

In the source driver circuit, in response to the current data stored in the first latch unit being provided to the data comparator, the current data: may be stored in the second latch unit, and may be used as previous data for a next scan line right of the current scan line.

In the source driver circuit: the source driver circuit may include a plurality of channels, and the data comparator may be provided in each channel.

The source driver circuit may further include: a shift register configured to: shift display data provided from an external source by a shift register clock signal, and store the display data in the first latch unit as current data, a level shifter configured to level-shift the current data provided from the first latch unit, and a decoder configured to: convert the current data which is level-shifted by the level shifter into analog data, based on a gray-scale voltage, and provide the analog data to the output buffer.

In the source driver circuit, the output buffer may include: pairs of first and second NMOS transistors configured to: receive the external buffer input signal and the buffer output signal through each gate, and generate a pair of first internal buffer input signals, pairs of first and second PMOS transistors configured to: receive the external buffer input signal and the buffer output signal through each gate, and generate a pair of second internal buffer input signals, a pair of first switches respectively connected to one of the pair of first NMOS transistors and one of the pair of second NMOS transistors, the pair of first switches configured to be respectively controlled by the descending and the ascending over-driver enable signals, a pair of second switches respectively connected one of the pair of first PMOS transistors and one of the pair of second PMOS transistors, the pair of first switches configured to be respectively controlled by the descending and the ascending over-driver enable signals, and an output buffer unit configured to: perform an over-driving operation, based on the pairs of first and second internal buffer input signals, and provide the output buffer signal including a target voltage greater than or less than the predetermined target voltage to the display panel.

In another general aspect, there is provided a source driver circuit including a plurality of channels, for driving a display panel including a plurality of scan lines, the source driver circuit including: a latch configured to latch data for a current scan line using a latch enable signal, a data comparator configured to: read out display data of a previous scan line of the current scan line for each channel as previous data in sequence, compare the current data provided from the latch and the previous data, and generate over-driving information for each channel, a shift register configured to store the display data as the current data and the over driving information, an enable signal latch configured to provide an ascending or a descending over-driver enable signal, based on the over-driving information provided from the shift register, and an output buffer configured to: perform an over-driving operation based on the ascending or descending over-driver enable signal, and provide: a buffer output signal including a target voltage greater than a predetermined target voltage with respect to the current data, which is an external buffer input signal, or a buffer output signal including a target voltage less than the predetermined target voltage to the display panel.

The source driver circuit may further include: an address decoding circuit configured to generate a data read enable signal, using the latch enable signal, based on an address signal of each channel, and a switch unit configured to provide current data of each channel to the data comparator, based on the data read enable signal.

In the source driver circuit, the output buffer may include: pairs of first and second NMOS transistors configured to: receive the external buffer input signal and the buffer output signal through each gate, and generate a pair of first internal buffer input signals, pairs of first and second PMOS transistors configured to: receive the external buffer input signal and the buffer output signal through each gate, and generate a pair of second internal buffer input signals, a pair of first switches respectively connected to one of the pair of first NMOS transistors and one of the pair of second NMOS transistors, the pair of first switches configured to be respectively controlled by the ascending and the descending over-driver enable signals, a pair of second switches respectively connected to one of the pair of first PMOS transistors and one of the pair of second PMOS transistors, the pair of second switches configured to be respectively controlled by the descending and the ascending over-driver enable signals, and an output buffer unit configured to: perform an over-driving operation, based on the pairs of first and second internal buffer input signals, and provide the output buffer signal including a target voltage greater than or less than the predetermined target voltage to the display panel.

In the source driver circuit, the data comparator may be further configured to be shared by the plurality of channels.

In another general aspect, there is provided a source driver circuit including a plurality of channels, for driving a display panel including a plurality of scan lines, the source driver circuit including: a buffer memory configured to store previous data for a previous scan line of each channel, a latch configured to latch display data of a next scan line of the previous scan line as current data, a data comparator configured to: read out previous data of each channel from a buffer memory in sequence, compare the current data provided from the latch and the previous data, and generate over-driving information for each channel, a shift register configured to store the display data and the over-driving information, an enable signal latch configured to provide an ascending or descending over-driver enable signal, based on the over-driving information provided from the shift register, and an output buffer configured to: perform an over-driving operation based on the ascending or descending over-driver enable signal, and provide: a buffer output signal including a target voltage greater than a predetermined target voltage with respect to the current data, which is an external buffer input signal, or a buffer output signal including a target voltage less than the predetermined target voltage to the display panel.

The source driver circuit may further include: an address decoding circuit configured to generate a read enable signal using the latch enable signal, based on an address signal of each channel, and a switch unit configured to provide the current data of each channel to the data comparator, based on the data read enable signal.

In the source driver circuit, the output buffer may include: pairs of first and second NMOS transistors configured to: receive the external buffer input signal and the buffer output signal through each gate, and generate a pair of first internal buffer input signals, pairs of first and second PMOS transistors configured to: receive the external buffer input signal and the buffer output signal through each gate, and generate a pair of second internal buffer input signals, a pair of first switches respectively connected to one of the pair of first NMOS transistors and one of the pair of second NMOS transistors, the pair of first switches configured to be respectively controlled by the ascending and the descending over-driver enable signals, a pair of second switches respectively connected to one of the pair of first PMOS transistors and one of the pair of second PMOS transistors, the pair of second switches configured to be respectively controlled by the ascending and the descending over-driver enable signals, and an output buffer unit configured to: perform an over-driving operation based on the pairs of first and second internal buffer input signals, and provide the output buffer signal including a target voltage greater than or less than the predetermined target voltage to the display panel.

In the source driver circuit, the data comparator and the buffer memory may be configured to be shared by the plurality of channels.

In another general aspect, there is provided a method of implementing an output buffer for a source driver circuit which receives an external buffer input signal and generates a buffer output signal including a predetermined target voltage, the method including: generating, by an over-driving controller, a pair of first internal buffer input signals and a pair of second internal buffer input signals for an over-driving operation, based on a first over-driver enable signal and a second over-driver enable signal, the first and second over driver signals being provided from an external source, performing, by an output buffer unit, the over-driving operation, based on the pair of first internal buffer input signals and the pair of second internal buffer input signals provided from the over-driving controller, and generating, by the output buffer unit: a buffer output signal including a target voltage greater than the predetermined target voltage, or a buffer output signal including a target voltage less than the predetermined target voltage.

The method may further include: receiving, by a first controller, the external buffer input signal as a first input signal and the buffer output signal as a second input signal, differentially amplifying, by the first controller, the first and the second input signals, based on the first and the second over-driver enable signals, outputting, by the first controller, the pair of first internal buffer input signals to the output buffer unit, receiving, by a second controller, the external buffer input signal as a first input signal and the buffer output signal as a second input signal, differentially amplifying, by the second controller, the first and the second input signals based on the first and the second over-driver enable signals, and outputting, by the second controller, the pair of second internal buffer input signals to the output buffer unit.

The method may further include: receiving, by a pair of first transistors, the first input signal through a gate, outputting, by the pair of first transistors, one of the pair of first internal buffer input signals to a drain, receiving, by a pair of second transistors, the second input signal through a gate, and outputting, by the pair of second transistors, the other one of the pair of first internal buffer input signals to a drain.

In the method, the first controller may further include: a first switch connected to one of the pair of first transistors in series and controlled by the second over-driver enable signal, and a second switch connected to one of the pair of second transistors in series and controlled by the first over-driver enable signal.

The method may further include: receiving, by a pair of third transistors, the second input signal through a gate, outputting, by the pair of third transistors, one of the pair of second internal buffer input signals to a drain, receiving, by a pair of fourth transistors, the first input signal through a gate, and outputting, by the pair of fourth transistors, the other one of the pair of second internal buffer input signals to a drain.

In the method, the second controller may include: a third switch connected to one of the pair of third transistors in series and controlled by the second over-driver enable signal, and a fourth switch connected to one of the pair of fourth transistors in series and controlled by the first over-driver enable signal.

The method may further include, in response to the first over-driver enable signal being enabled: closing the first switch and opening the second switch, such that a size of the pair of first transistors is smaller than a size of the pair of second transistors, closing the third switch and opening the fourth switch, such that a size of the pair of third transistors is smaller than a size of the pair of fourth transistors, and providing, by the over-driving controller, the pairs of first and second internal buffer input signals for an ascending over-driving operation to the output buffer unit.

The method may further include, in response to the second over-driver enable signal being enabled: opening the first switch and closing the second switch, such that a size of the pair of first transistors is larger than a size of the pair of second transistors, opening the third switch and closing the fourth switch, such that a size of the pair of third transistors is lager than a size of the pair of fourth transistors, and providing, by the over-driving controller, the pairs of first and second internal buffer input signals for a descending over-driving operation to the output buffer unit.

The method may further include, in response to the first and the second over-driver enable signals being disabled: closing the first and the second switches, such that a size of the pair of first transistors is a same as a size of the pair of second transistors, closing the third and the fourth switch, such that a size of the pair of third transistors is a same as a size of the pair of fourth transistors, and providing, by the over-driving controller, the pairs of first and second internal buffer input signals for a normal driving operation to the output buffer unit.

In another general aspect, there is provided a method of implementing a source driver circuit for driving a display panel including a plurality of scan lines, the method including: receiving, by an output buffer, current data to be displayed on a current scan line of the plurality of scan lines as an external buffer input signal, providing, by the output buffer, a buffer output signal including a predetermined target voltage to the display panel, compare, by a data comparator, the current data and previous data displayed on a previous scan line of the current scan line, and output, by the data comparator, first and second control signals to the output buffer, such that the output buffer generates: a buffer output signal including a target voltage greater than the predetermined target voltage, or a buffer output signal including a target voltage less than the predetermined target voltage.

In another general aspect, there is provided a method of implementing a source driver circuit for driving a display panel including a plurality of scan lines, the method including: storing, by a latch: current data to be displayed on a current scan line of the plurality of scan lines, and previous data displayed on a previous scan line of the current scan line, comparing, by a data comparator, the current data and the previous data provided from the latch, generating, by the data comparator, an ascending over-driver enable signal or a descending over-driver enable signal, in response to the current data being greater than or less than the previous data by an over-driving threshold data, performing, by an output buffer, an over-driving operation based on the ascending or descending over-driver enable signal, and providing, by the output buffer: a buffer output signal including a target voltage greater than a predetermined target voltage with respect to the current data, which is an external buffer input signal, or a buffer output signal including a target voltage less than the predetermined target voltage to the display panel.

In another general aspect, there is provided a method of implementing a source driver circuit including a plurality of channels, for driving a display panel including a plurality of scan lines, the method including: latching data, by a latch, for a current scan line using a latch enable signal, reading out, by a data comparator, display data of a previous scan line of the current scan line for each channel as previous data in sequence, comparing, by the data comparator, the current data provided from the latch and the previous data, and generating, by the data comparator, over-driving information for each channel, storing, by a shift register, the display data as the current data and the over-driving information, providing, by an enable signal latch, an ascending or a descending over-driver enable signal, based on the over-driving information provided from the shift register, performing, by an output buffer, an over-driving operation based on the ascending or descending over-driver enable signal, and providing, by the output buffer: a buffer output signal including a target voltage greater than a predetermined target voltage with respect to the current data, which is an external buffer input signal, or a buffer output signal including a target voltage less than the predetermined target voltage to the display panel.

In another general aspect, there is provided a method of implementing a source driver circuit which includes a plurality of channels, for driving a display panel including a plurality of scan lines, the method including: storing, by a buffer memory, previous data for a previous scan line of each channel, latching, by a latch, display data of a next scan line of the previous scan line as current data, reading out, by a data comparator, previous data of each channel from a buffer memory in sequence, comparing, by the data comparator, the current data provided from the latch and the previous data, generating, by the data comparator, over-driving information for each channel, storing, by a shift register, the display data and the over-driving information, providing, by an enable signal latch, an ascending or descending over-driver enable signal, based on the over-driving information provided from the shift register, performing, by an output buffer, an over-driving operation based on the ascending or descending over-driver enable signal, and providing, by the output buffer: a buffer output signal including a target voltage greater than a predetermined target voltage with respect to the current data, which is an external buffer input signal, or a buffer output signal including a target voltage less than the predetermined target voltage to the display panel.

Other features and aspects may be apparent from the following detailed description, the drawings, and the claims.

Figure 1A:
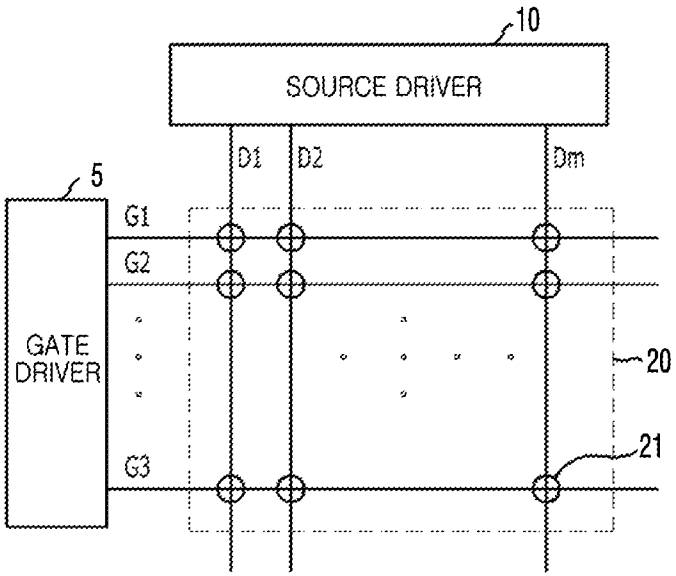
FIG. 1A is a schematic block diagram illustrating a flat panel display apparatus according to an example embodiment.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Figure 1B:
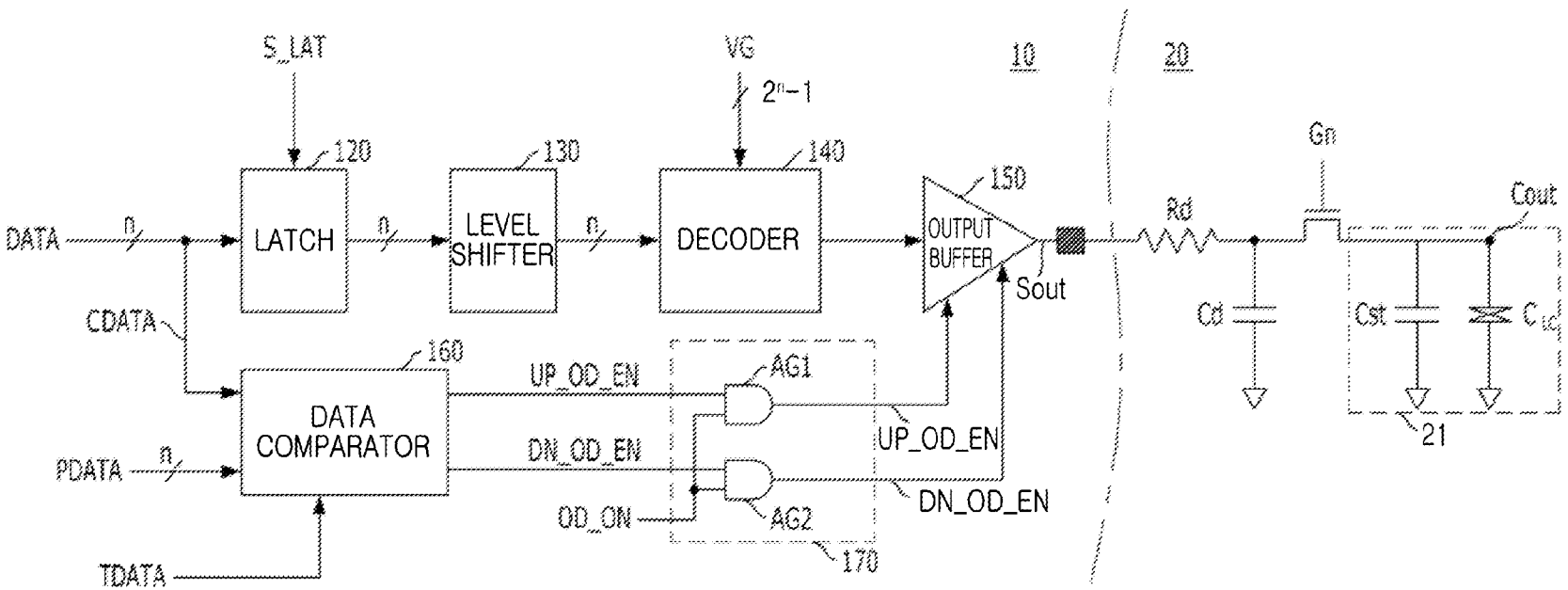
FIG. 1B is a block diagram illustrating a source driver circuit for a flat panel display apparatus according to an example embodiment.
Figure 2:
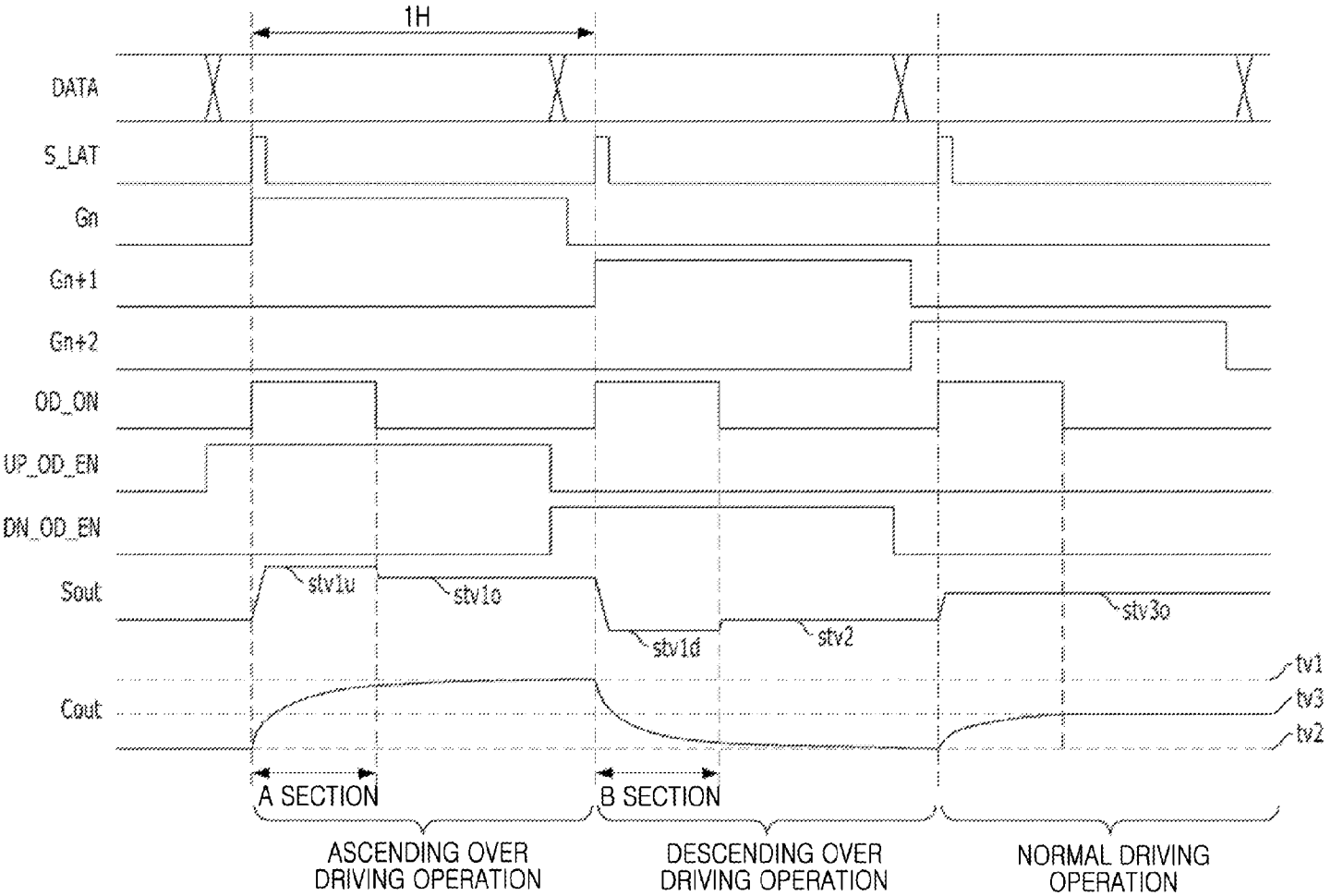
FIG. 2 is a waveform diagram illustrating the operation of the source driver circuit of FIG. 1.

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. The progression of processing steps and/or operations described is an example; however, the sequence of steps and/or operations is not limited to that set forth herein and may be changed as is known in the art, with the exception of steps and/or operations necessarily occurring in a certain order. Also, descriptions of well-known functions and constructions may be omitted for increased clarity and conciseness. FIGS. 1A, 1B and 2 illustrate a flat panel display element and operation thereof.

FIG. 1A is a schematic block diagram illustrating a flat panel display apparatus according to an example embodiment. Referring to FIG. 1A, the flat panel display apparatus includes a gate driver 5 which provides a driving signal to a plurality of gate lines (G1-Gn), a source driver circuit 10 which provides a data signal to a plurality of data lines (D1-Dm), and a display panel 20 on which a plurality of pixels 21 are disposed at a crossing of the gate lines (G1-Gn) and the data lines (D1-Dm).

The pixels 21 disposed on the display panel 20 may be driven by a gate driving signal which is provided to the gate lines (G1-Gn) from the gate driver 5, and may display an image, based on data which is provided to the data lines (D1-Dm) from the source driver 10. The display panel 20 may include a liquid crystal display (LCD) panel.

The flat panel display may further include a controller (not shown) to control the gate driver 5 and the source driver circuit 10.

FIG. 1B is a block diagram illustrating a source driver circuit for a flat panel display apparatus according to an example embodiment. Referring to FIG. 1A, the flat panel display element includes a source driver circuit 10 and a display panel 20. The display panel 20 may include, but is not limited to, a liquid crystal panel. A plurality of scan lines (not shown), a plurality of data lines (not shown), and a plurality of unit pixels 21 connected to the plurality of scan lines and the plurality of data lines are arranged on the display panel 20. Each of the unit pixels 21 includes a liquid crystal capacitor $C_{LC}$ and a storage capacitor $C_{st}$ as a pixel load. A gain transistor Gn is connected to the input of each of the unit pixels 21.

The source driver circuit 10 includes a latch 120 to latch current data (CDATA) of a predetermined bit using a latch enable signal (S_LAT) having the same period as one horizontal period (1H), a level shifter 130 to shift a level of the current data stored in the latch 120, a decoder 140 to convert the current data which has been level-shifted by the level shifter 130 into analog data based on a gray-scale voltage (VG), and an output buffer 150 to generate an output signal (Sout) having a predetermined target voltage (e.g., Stv1*o*) to drive the display panel 20 based on an output signal output from the decoder 140. If the current data (CDATA) is n-bit data, the number of the gray-scale voltages (VG) is $2^n-1$.

The source driver circuit 10 further includes a data comparator 160 to receive the current data (CDATA) and previous data (PDATA), and to compare the current data (CDATA) and the previous data (PDATA).

The data comparator 160 may compare the current data (CDATA) and the previous data (PDATA) based on over-driving threshold data (TDATA), and may generate an over-driver enable signal (OD_EN). For example, if the current data (CDATA) is data to be displayed on an $m^{th}$ scan line of the plurality of scan lines (not shown) of the display panel 20, the previous data (PDATA) is data already displayed on an $m-1^{th}$ scan line.

If the current data (CDATA) is greater than the previous data (PDATA) by the over-driving threshold data (TDATA) as a result of comparing the current data (CDATA) and the previous data (PDATA) by the data comparator 160, the data comparator 160 generates an ascending over-driver enable signal (UP_OD_EN) to control the output buffer 150 to generate an output signal (Sout) greater than the target voltage, and may output the ascending over-driver enable signal (UP_D_EN) to the output buffer 150. If the current data (CDATA) is less than the previous data (PDATA) by the over-driving threshold data (TDATA) as a result of comparing by the data comparator 160, the data comparator 160 generates a descending over-driver enable signal (DN_OD_EN) to control the output buffer 150 to generate an output signal (Sout) less than the target voltage, and may output the descending over-driver enable signal (DN_OD_EN) to the output buffer 150.

If the current data (CDATA) is neither greater than nor less than the previous data by the over-driving threshold data (TDATA), the data comparator 160 may disable the ascending over-driver enable signal (UP_OD_EN) and the descending over-driver enable signal (DN_OD_EN), such that the output buffer 150 may perform a normal driving operation, rather than an ascending or descending over-driver operation, and may generate an output signal (Sout) having a predetermined target voltage.

Also, if the source driver circuit 10 includes a plurality of channels, and each channel includes the latch 120, the level shifter 130, the decoder 140, and the output buffer 150, then the data comparator 160 may be arranged in every channel along with the aforementioned elements. Alternatively, the data comparator 160 may be arranged to be shared by the plurality of channels.

The source driver circuit 10 further includes an over-driving enable unit 170 to control an enable section of the ascending over-driver enable signal (UP_OD_EN) and the descending over-driver enable signal (DN_OD_EN) output from the data comparator 160, based on an over-driving on signal (OD_ON). The over-driving enable unit 170 may control the output buffer 150 to perform the ascending or descending over-driving operation by the over-driver enable signal (OD_EN) provided from the data comparator 160, but, after the output signal (Sout) is generated by the output buffer 150 and a voltage signal of a predetermined size is applied to the load of each unit pixel 21 of the display panel 20, may control the output buffer 150 to not perform the over-driving operation any more.

The over-driving enable unit 170 may control the output buffer 150 to perform the over-driving operation only in an enable section of the over-driving on signal (OD_ON). For example, the over-driving enable unit 170 includes a first AND gate (AG1) to control the enable section of the ascending over-driver enable signal (UP_OD_EN) based on the over-driving on signal (OD_ON), and a second AND gate (AG2) to control the enable section of the descending over-driver enable signal (DN_OD_EN) based on the over-driving on signal (OD_ON).

The operation of the source driver circuit 10 having the above-described configuration will be explained with reference to FIG. 2.

The display data (DATA) of the predetermined bit, for example, the display data of n bits, may be latched as current data (CDATA) at the latch 120 by the latch enable signal (S_LAT) having the same period as 1H. The current data (CDATA) stored in the latch 120 may be level-shifted by the level shifter 130 and provided to the decoder 140. The decoder 140 may convert the level-shifted current data into analog data based on the $2^n-1$ gray-scale voltages (VG), and may provide the analog data to the output buffer 150.

The data comparator 160 may compare the current data (CDATA) and the previous data (PDATA) based on the over-driving threshold data (TDATA). As a result, if the current data (CDATA) is greater than the previous data (PDATA) by the over-driving threshold data (TDATA), the data comparator 160 may output the ascending over-driver enable signal (UP_OD_EN) to the output buffer 150, as shown in FIG. 2.

Upon receiving the ascending over-driver signal (UP_D_EN) from the data comparator 160, the output buffer 150 may perform the ascending over-driving operation, and may generate an output signal (Sout) having a target voltage (Stv1*u*) greater than the target voltage (Stv1*o*). The output signal (Sout) may be provided to the unit pixel 21 of the display panel 20 through loads (Rd, Cd of FIG. 1) of the output terminal. In other words, the output buffer 150 may output the output signal (Sout) having the target voltage (Stvlu) greater than the target voltage (Stv1*o*) during the ascending over-driving operation, such that a voltage (Cout) of the unit pixel 21 of the display panel 20 reaches a target value (tv1) rapidly. A first gain Gn may be operate during the ascending over-driving operation. Therefore, the voltage (Cout) of the unit pixel 21 may reach the desired target value (tv1) rapidly within the 1H section, as shown in FIG. 2.

At this time, the over-driver enable signal (UP_OD_EN) may be provided to the output buffer 150 by the over-driving enable unit 170 during only the enable period of the over-driving on signal (OD_ON). Therefore, the output buffer 150 may perform the over-driving operation only in an "A" section. If the voltage (Cout) of the unit pixel 21 of the display panel 20 exceeds a predetermined value, the output buffer 150 may not perform the over-driving operation any more, and may perform the normal driving operation, such that current consumption caused by unnecessary over-driving operation may be prevented.

On the other hand, if the current data (CDATA) is less than the previous data (PDATA) by the over-driving threshold data (TDATA), the data comparator 160 may provide the descending over-driver enable signal (DN_OD_EN) to the output buffer 150. A second gain (Gn+1) may be operate during the descending over-driving operation. The output buffer 150 may perform the descending over-driving operation, and may provide the output voltage (Sout) having a target voltage (Stv1*d*) less than a target voltage (Stv2) to the display panel 20, as shown in FIG. 2. Accordingly, the voltage (Cout) of the unit pixel 21 of the display panel 20 may rapidly reach a second target value (tv2) by the output signal (Sout) having the small target voltage (Stv2) provided from the output buffer 150.

The descending over-driving operation may be performed only in a "B" section in which the over-driving on signal (OD_ON) is enabled by the over-driving enable unit 170. If the voltage (Cout) of the unit pixel 21 of the display panel 20 falls below a predetermined value, due to the output signal having the small target voltage (Stv1*d*) provided from the output buffer 150, as shown in FIG. 2, the over-driving operation may not be performed, and the normal driving operation may be performed such that current consumption caused by unnecessary over-driving operation can be prevented.

On the other hand, if the current data (CDATA) is neither greater than nor less than the previous data (PDATA) by the over-driving threshold data (TDATA), the ascending over-driver enable signal (UP_OD_EN) or the descending over-driver enable signal (DN_OD_EN) provided from the data comparator 160 may be disabled. A third gain (Gn+2) may be operate during the normal driving operation. Accordingly, the output buffer 150 may perform the normal driving operation to generate an output signal (Sout) having a predetermined target voltage (Stv3*o*), and may output the output signal (Sout) to the display panel 20, as shown in FIG. 2. Therefore, the voltage (Cout) of the unit pixel 21 of the display panel 20 may reach a predetermined target voltage (tv3).

Figure 3:
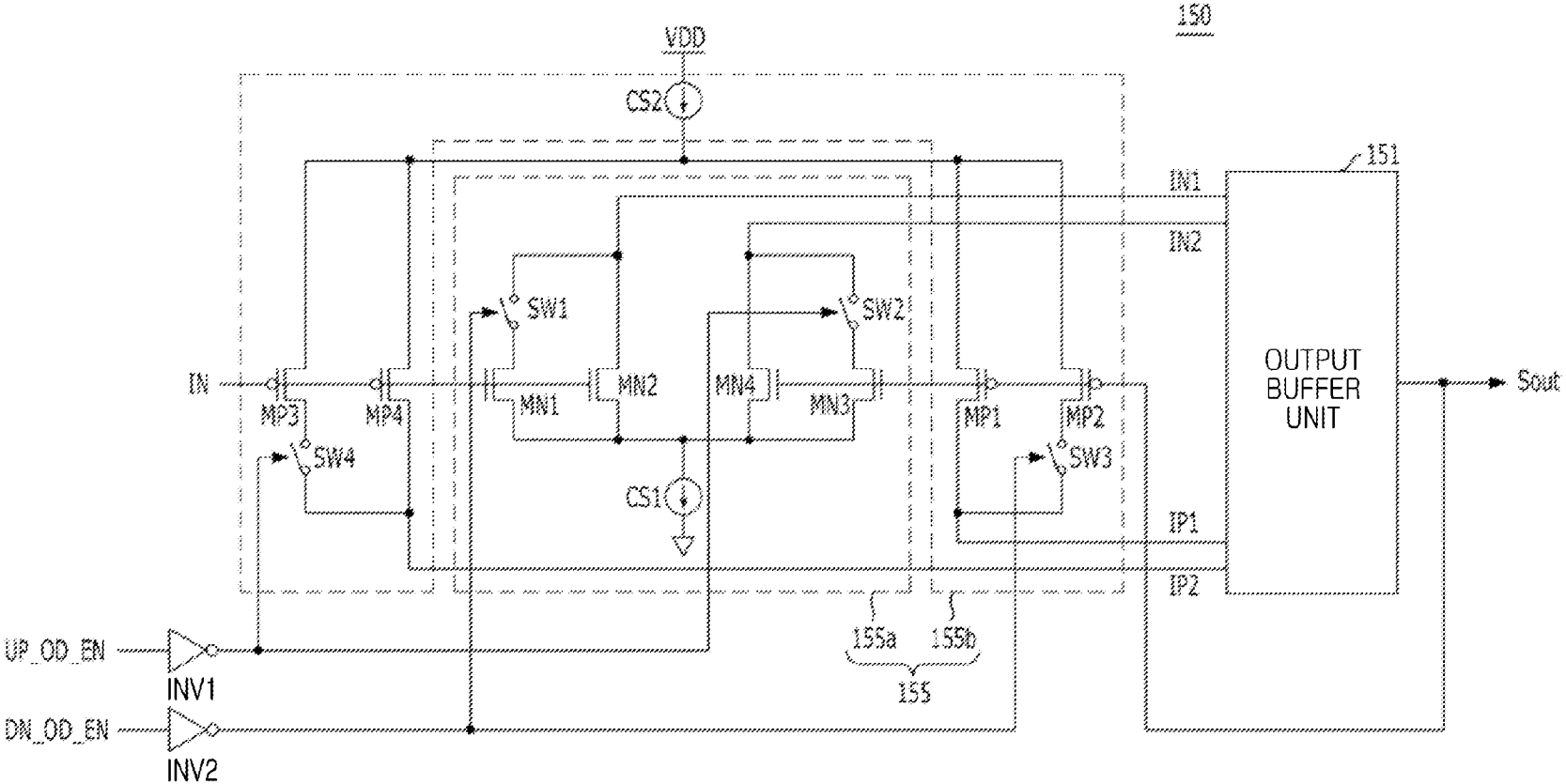
FIG. 3 is a circuit diagram illustrating the output buffer of the source driver circuit of FIG. 1.

FIG. 3 is a circuit diagram illustrating the over-drivable output buffer 150 of FIG. 1 according to an example embodiment. Referring to FIG. 3, the output buffer 150 includes an output buffer unit 151 to output an output signal (Sout) having a predetermined target voltage with respect to an input signal (IN) to the display panel 20, and an over-driving controller 155 to control the over-driving operation of the output buffer unit 151. The input signal (IN) is current data provided from the decoder 140 of FIG. 1, and may refer to an external buffer input signal. The output signal (Sout) may be a buffer output signal.

During the normal driving operation, the output buffer unit 151 may generate a buffer output signal (Sout) having a predetermined target voltage (Stv3*o*) with respect to the external buffer input signal (IN), based on a pair of first internal buffer input signals (IN1, IN2) and a pair of second internal buffer input signals (IP1, IP2) provided from the over-driving controller 155. During the over-driving operation, the output buffer unit 151 may provide the display panel 20 with a buffer output signal (Sout) having a target voltage (Stv1*u*) greater than a target voltage (Stv1*o*) with respect to the external buffer input signal (IN) or a buffer output signal (Sout) having a target voltage (Stv1*d*) less than a target voltage (Stv2), based on the pair of first internal buffer input signals (IN1, IN2) and the pair of second internal buffer input signals (IP1, IP2) provided from the over-driving controller 155. The output buffer unit 151 may be a two-step output buffer used in the source driver circuit.

The over-driving controller 155 provides the pair of first internal buffer input signals (IN1, IN2) and the pair of second internal buffer input signals (IP1, IP2) to the output buffer unit 151, based on the ascending over-driver enable signal (UP_OD_EN) and the descending over-driver enable signal (DN_OD_EN). The over-driving controller 155 includes a first controller 155*a* to generate the pair of first internal buffer input signals (IN1, IN2) and a second controller 155*b* to generate the pair of second internal buffer input signals (IP1, IP2). The over-driving controller 155 may further include inverters (INV1, INV2) to invert the ascending and the descending over-driver enable signals (UP_OD_EN, DN_OD_EN).

The first and the second controllers 155*a*, 155*b* may differentially amplify the external buffer input signal (IN), which may be a first input signal, and the buffer output signal (Sout), which may be a second input signal, based on the ascending over-driver enable signal (UP_OD_EN) and the descending over-driver enable signal (DN_OD_EN), generating the pair of first internal buffer input signals (IN1, IN2) and the pair of second internal buffer input signals (IP1, IP2).

The first controller 155*a* includes a pair of first differential transistors (MN1, MN2) to receive the external buffer input signal (IN) through gates thereof and output one (IN1) of the pair of first internal buffer input signals (IN1, IN2) to a drain, and a pair of second differential transistors (MN3, MN4) to receive the buffer output signal (Sout) through gates thereof and output one (IN2) of the pair of first internal buffer input signals (IN1, IN2) to a drain. The pairs of first and second differential transistors (MN1, MN2), (MN3, MN4) may include pairs of NMOS transistors. The pair of first internal buffer input signals (IN1, IN2) may include differential current generated by the pair of first differential transistors (MN1, MN2) and the pair of second differential transistors (MN3, MN4), respectively.

The first controller 155*a* further includes a first switch (SW1) which is connected to one (MN1) of the pair of first differential transistors (MN1, MN2) and may be controlled by the descending over-driver enable signal (DN_OD_EN), and a second switch (SW2) which is connected to one (MN3) of the pair of second differential transistors (MN3, MN4) and may be controlled by the ascending over-driver enable signal (UP_OD_EN). In this example, the first and the second switches (SW1, SW2) are connected to the other respective NMOS transistors (MN2, MN3). The first controller 155*a* further includes a current source (CS1) connected between the pairs of first and second differential transistors and a ground potential.

The second controller 155*b* includes a pair of third differential transistors (MP1, MP2) to receive the buffer output signal (Sout) through each gate thereof and output one (IP1) of the pair of second internal buffer input signals (IP1, IP2) to a drain, and a pair of fourth differential transistors (MP3, MP4) to receive the external buffer input signal (IN) through each gate thereof and output the other one (IP2) of the pair of second internal buffer input signals (IP1, IP2) to a drain. The pairs of third and fourth differential transistors (MP1, MP2), (MP3, MP4) may include pairs of PMOS transistors. The pair of second internal buffer input signals (IP1, IP2) may include differential current generated by the pair of third differential transistors (MP1, MP2) and the pair of fourth differential transistors (MP3, MP4), respectively.

The second controller 155*b* further includes a third switch (SW3) which is connected to one (MP1) of the pair of third differential transistors (MP1, MP2) and may be controlled by the descending over-driver enable signal (DN_OD_EN), and a fourth switch (SW4) which is connected to one (MP3) of the pair of fourth differential transistors (MP3, MP4) and may be controlled by the ascending over-driver enable signal (UP_OD_EN). In this example, the third and the fourth switches (SW3, SW4) are connected to the other respective PMOS transistors (MP2, MP4) of the pairs of third and fourth differential transistors. The second controller 155*b* may further include a current source (CS2) connected between the pairs of third and fourth differential transistors and a power supply voltage (VDD).

The operation of the output buffer 150 will be explained with reference to FIGS. 4A to 4C and FIGS. 5A to 5C.

Figure 4A:
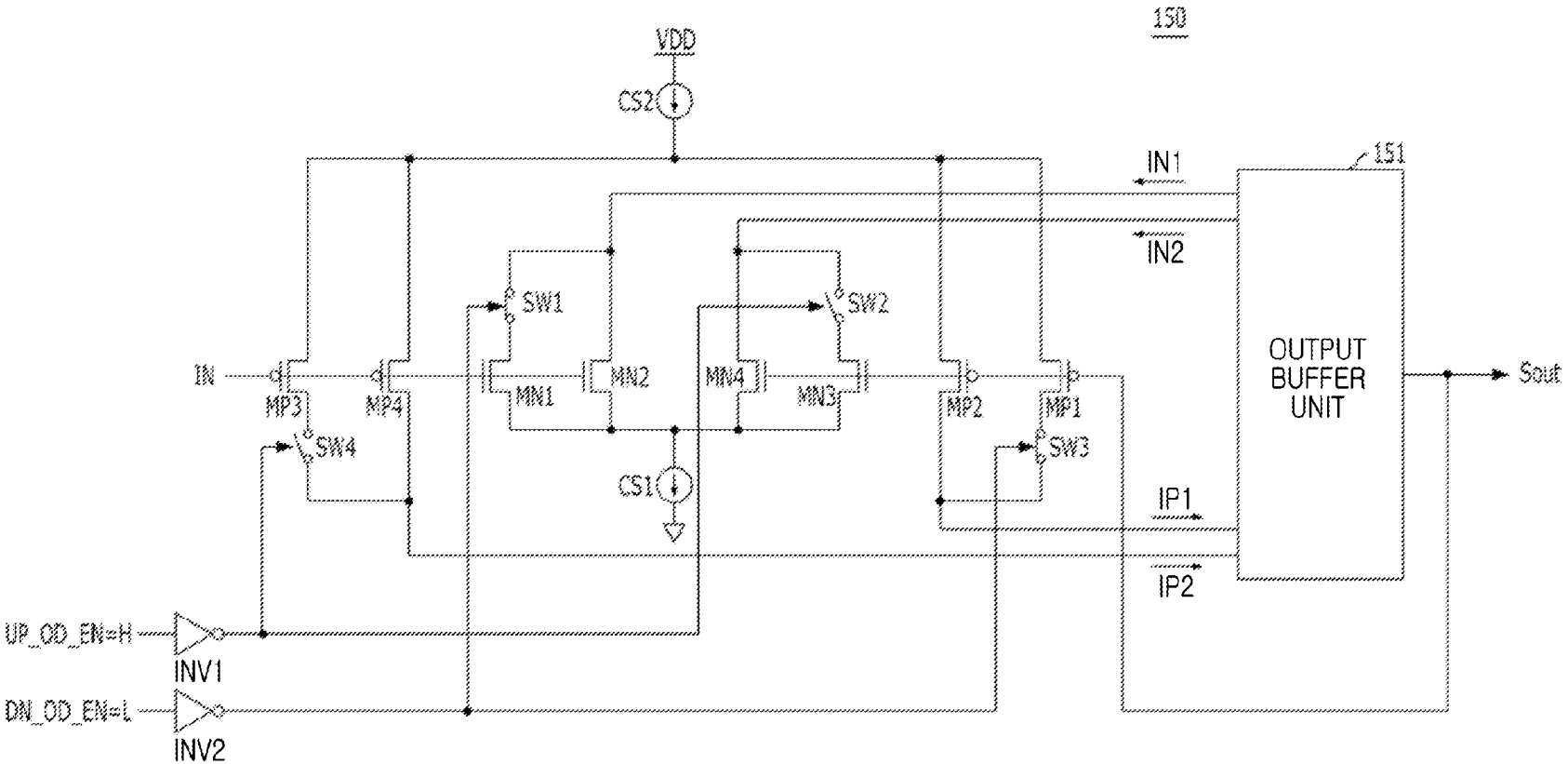
FIGS. 4A to 4C are views to explain the driving operation of the output buffer of FIG. 3.
Figure 5A:
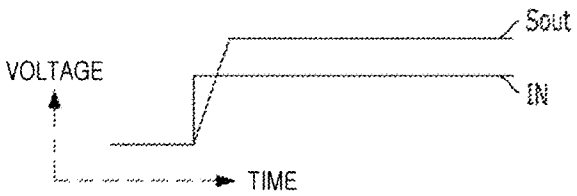
FIGS. 5A to 5C are waveform diagrams illustrating the operation of the output buffer of FIGS. 4A to 4C.

Referring to FIGS. 4A and 5A, if a mismatching characteristic is disregarded, the pair of first internal buffer input signals (IN1, IN2) provided to the output buffer unit 151 becomes IN1=IN2, and the pair of second internal buffer input signals (IP1, IP2) becomes IP1=IP2; the output buffer unit 151 may be placed in a steady state. At this time, if the ascending over-driver enable signal (UP_OD_EN) of a high state and the descending over-driver enable signal (DN_

OD_EN) of a low state are provided from the data comparator 160, the first and the third switches (SW1, SW3) may be short-circuited (e.g., closed), and the second and the fourth switches (SW2, SW4) may be open-circuited (e.g., open).

Accordingly, a size of the pair of first differential transistors (MN1, MN2) may be smaller than a size of the pair of second differential transistors (MN3, MN4), and a size of the pair of third differential transistors (MP1, MP2) may be smaller than a size of the pair of fourth differential transistors (MP3, MP4). Therefore, the over-driving controller 155 may generate and output the pairs of first and second internal buffer input signals (IN1, IN2), (IP1, IP2) for ascending over-driving to the output buffer unit 151, and the output buffer unit 151 may perform the ascending over-driving operation to generate the buffer output signal (Sout) having the high target voltage with respect to the external buffer input signal (IN), as shown in FIG. 5A. In other words, the buffer output signal (Sout) having the target voltage (Stv1*u*) greater than the target voltage (Stvlo) may be generated, as in the "A" section of FIG. 2.

Figure 4B:
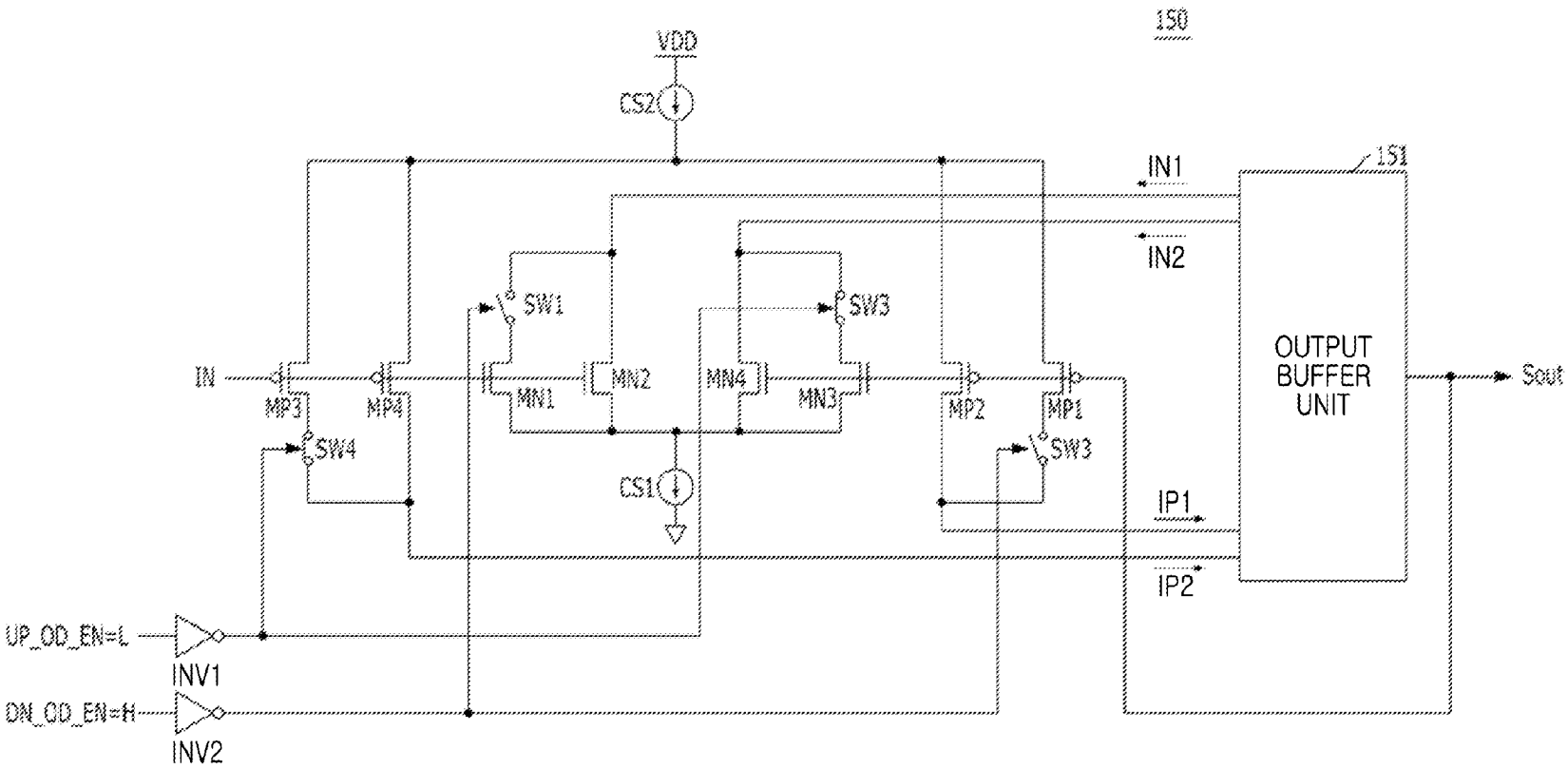
Figure 5B:
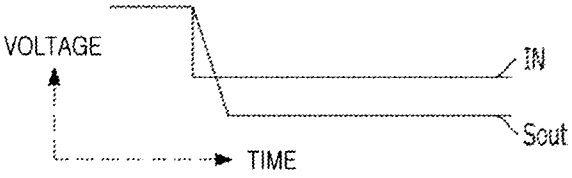

Referring to FIGS. 4B and 5B, if the ascending over-driver enable signal (UP_OD_EN) of a low state and the descending over-driver enable signal (DN_OD_EN) of a high state are provided from the data comparator 160, the first and the third switches (SW1, SW3) may be open-circuited (e.g., open) and the second and the fourth switches (SW2, SW4) may be short-circuited (e.g., closed). Therefore, the size of the pair of first differential transistors (MN1, MN2) may be larger than the size of the pair of second differential transistors (MN3, MN4), and the size of the pair of third differential transistors (MP1, MP2) may be larger than the size of the pair of fourth differential transistors (MP3, MP4). Therefore, the over-driving controller 155 may generate and output the pairs of first and second internal buffer input signals (IN1, IN2), (IN1, IN2) for descending over-driving to the output buffer unit 151, and the output buffer unit 151 may perform the descending over-driving operation to generate the buffer output signal (Sout) having the low target voltage with respect to the external buffer input signal (IN). In other words, the output buffer unit 151 may generate and output the buffer output signal (Sout) having the target voltage (Stv1*d*) lower than the target voltage (Stv2) to the display panel 20, as in the "B" section FIG. 2.

Figure 4C:
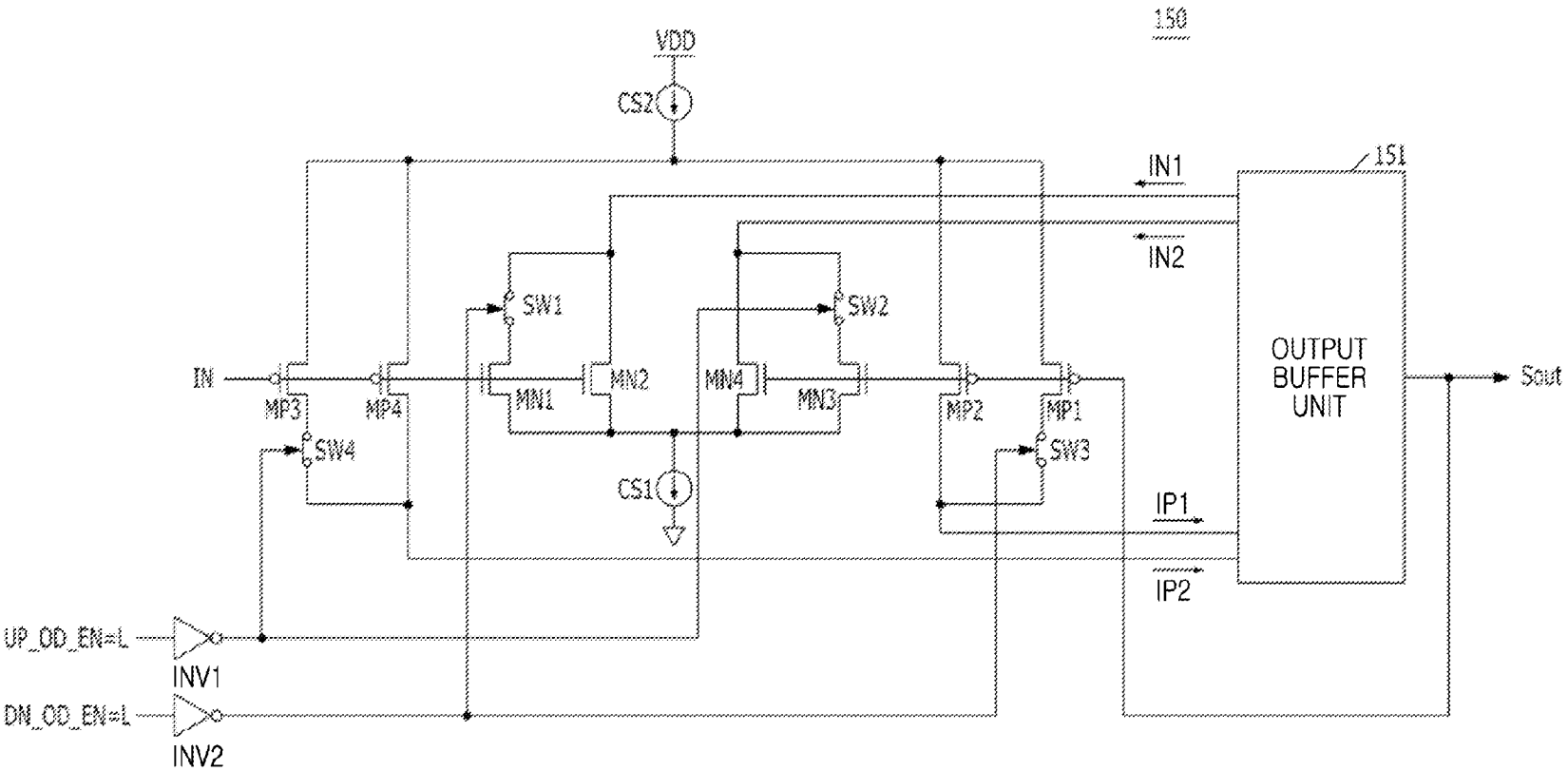
Figure 5C:
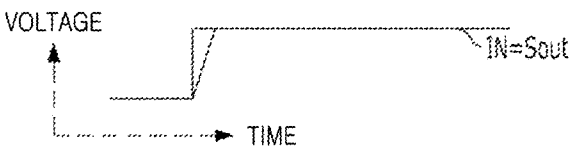

Referring to FIGS. 4C and 5C, if the ascending over-driver enable signal (UP_OD_EN) of the low state and the descending over-driver enable signal of the low state are provided from the data comparator 160, all of the first to the fourth switches (SW1-SW4) may be short-circuited (e.g., closed). Accordingly, the pairs of first and second differential transistors (MN1, MN2), (MN3, MN4) may have the same size, and the pairs of third and fourth differential transistors (MP1, MP2), (MP3, MP4) may have the same size. Therefore, if a mismatching characteristic is disregarded, the pairs of first and second internal buffer input signals may be IN1=IN2 and IP1=IP2, and may be maintained in a steady state. Therefore, the output buffer unit 151 may not perform the over-driving operation, and may perform the normal driving operation to generate the buffer output signal (Sout) having the target voltage (Stv3*o* of FIG. 2) corresponding to the external buffer input signal (IN).

Figure 6:
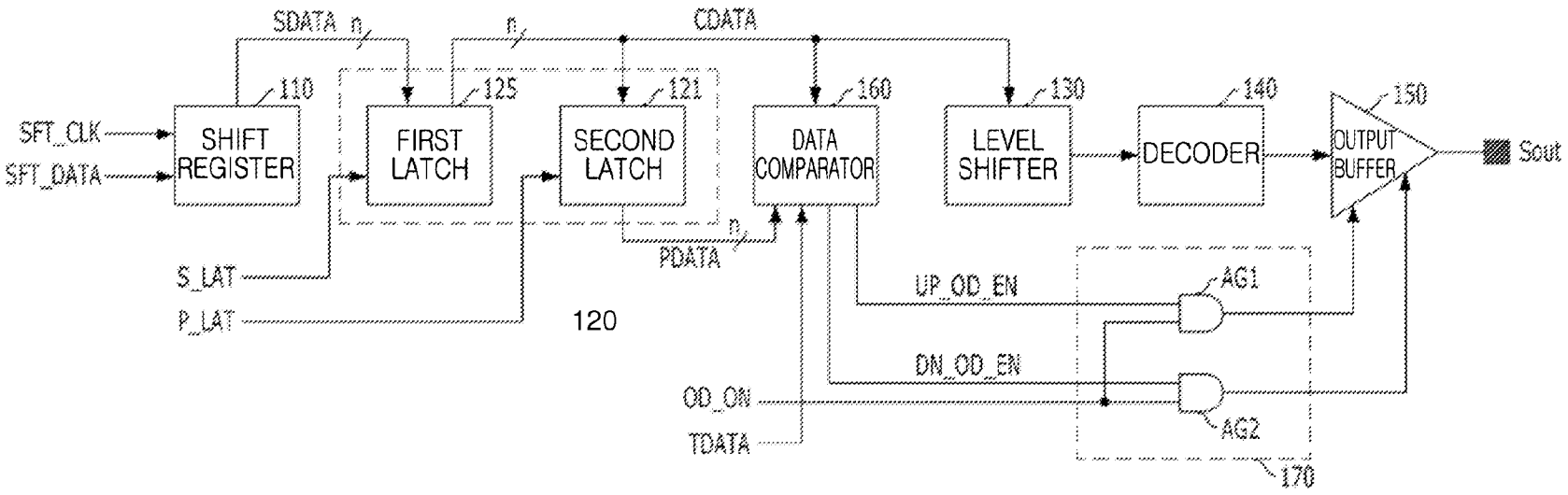
FIG. 6 is a block diagram illustrating a source driver circuit according to another example embodiment.

FIG. 6 is a block diagram illustrating a source driver circuit comprising an over-drivable output buffer for a flat panel display element according to another example embodiment.

Referring to FIG. 6, a source driver circuit 610 according to another example embodiment may include a latch 120, a level shifter 130, a decoder 140, an output buffer 150, a data comparator 160, and an over-driving enable unit 170. Each element may perform the same operation as described above. The source driver circuit 610 further includes a shift register 110 to shift display data (SFT_DATA) using a shift register clock signal (SFT_CLK) and provide the display data to the latch 120.

The latch 120 includes first and second latch units 125 and 121, respectively, to store current data (CDATA) and previous data (PDATA). The first latch unit 125 may latch shifted data (SDATA) provided from the shift register 110 based on a latch signal (S_LAT) having the same period as 1H. The second latch unit 121 may latch the current data (CDATA) provided from the first latch unit 125 to the data comparator 160 based on a latch signal (P_LAT) having the same period as 1H. The current data (CDATA) stored in the second latch unit 121 may be provided to the data comparator 160 as previous data in response to the display data being provided to a next scan line of a current scan line.

The data comparator 160 may compare the current data (CDATA) and the previous data (PDATA) provided from the first and the second latch units 125 and 121, respectively, and generate an over-driver enable signal (OD_EN). The level shifter 130 may level-shift the current data (CDATA) provided from the first latch unit 125, and may provide the level-shifted data to the decoder 140. In an example of a source driver circuit including a plurality of channels, the data comparator 160 may be placed in every channel, and may compare current data of a corresponding channel and previous channel.

Figure 7:
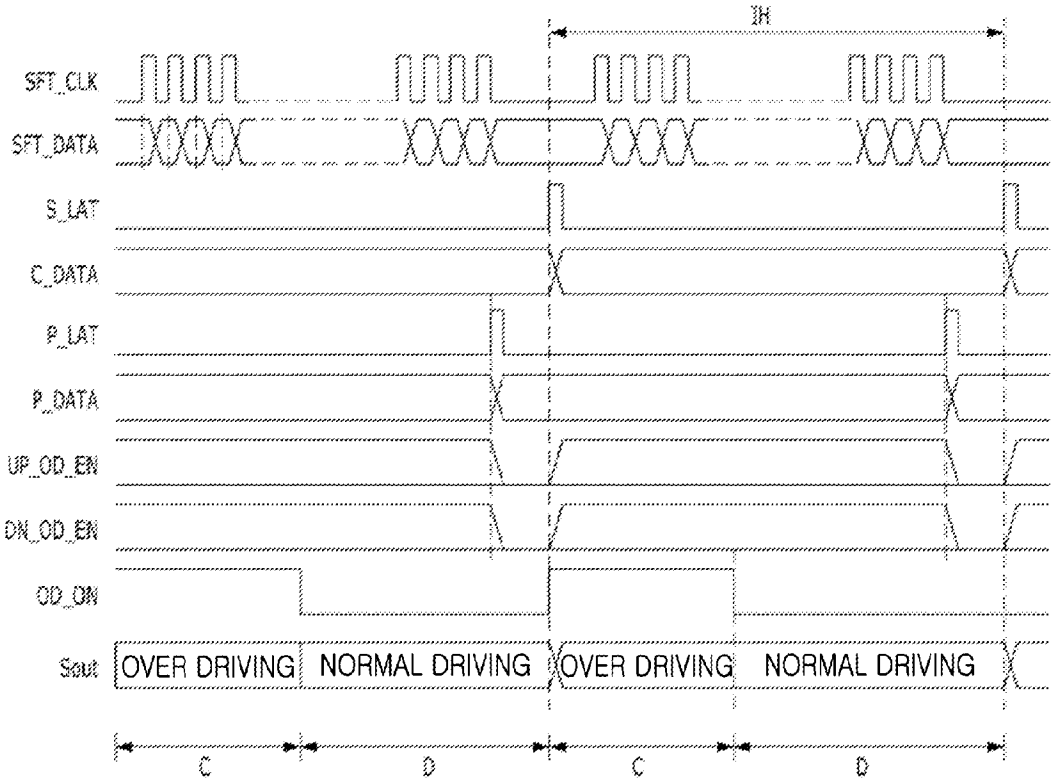
FIG. 7 is a waveform diagram illustrating the operation of the source driver circuit of FIG. 6.

The operation of the source driver circuit of FIG. 6 having the above-described configuration will be explained with reference to FIG. 7.

The shift register 110 may shift the display data (SFT_DATA) using the shift register clock signal (SFT_CLK), and the first latch unit 125 may latch the shift data (SDATA) corresponding to the 1H as current data (CDATA) based on the latch enable signal (S_LAT). The current data (CDATA) stored in the first latch unit 125 may be latched at the second latch unit 125 by the latch enable signal (P_LAT), and may act as the previous data of the next scan line.

The data comparator 160 may compare the current data (CDATA) stored in the first latch unit 125 and the previous data (PDATA) stored in the second latch unit 121. If the current data (CDATA) is greater than or less than the previous data (PDATA) by other over-driving threshold data (TDATA) as a result of comparing, the output buffer 150 may perform the over-driving operation as in a "C" section, and if not, the output buffer 150 may perform the normal driving operation as in a "D" section.

Figure 8:
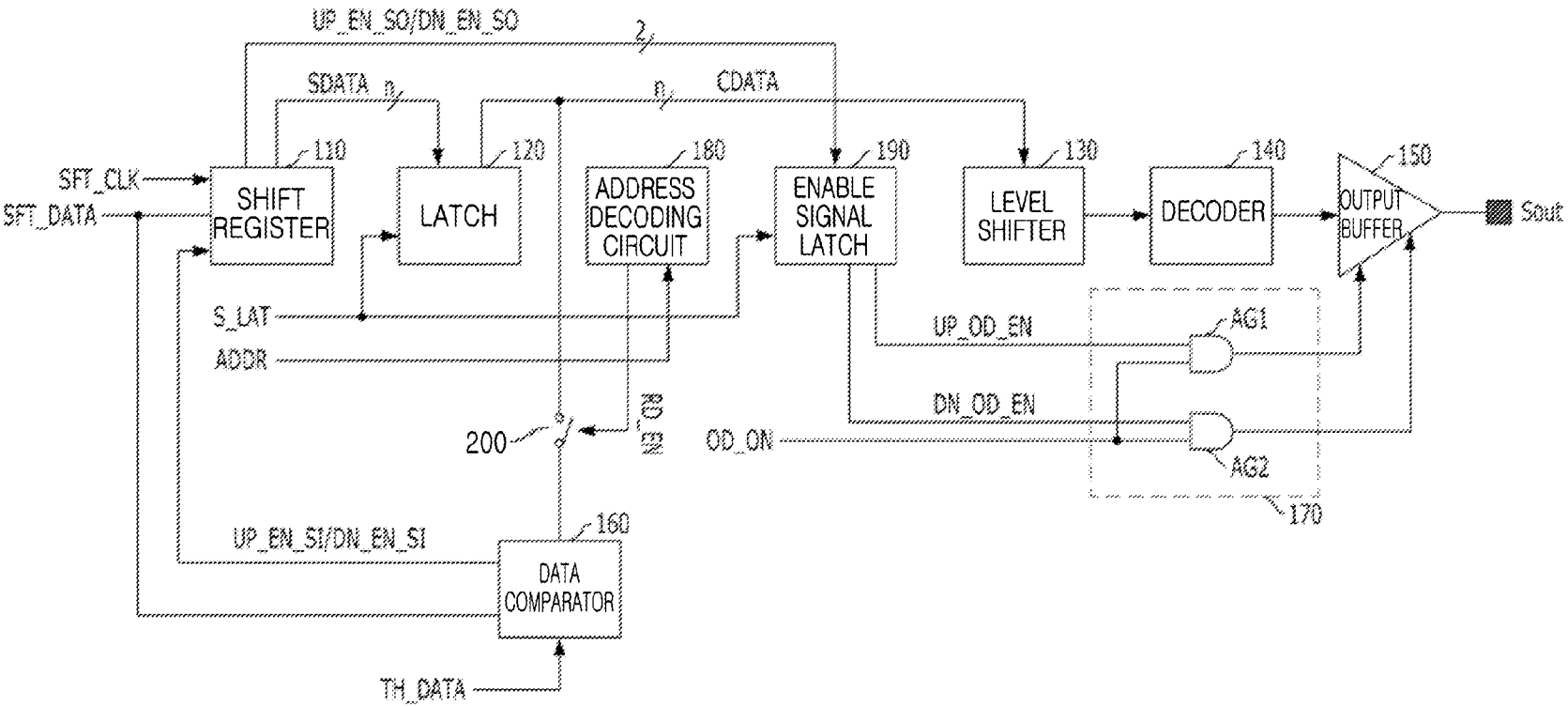
FIG. 8 is a block diagram illustrating a source driver circuit according to still another example embodiment.

FIG. 8 is a block diagram illustrating a source driver circuit according to still another example embodiment. Referring to FIG. 8, a source driver circuit 810 according to still another example embodiment includes a shift register 110, a latch 120, a level shifter 130, a decoder 140, an output buffer 150, a data comparator 160, and an over-driving enable unit 170, and each element performs the same operation as described above.

However, in an example of a source driver circuit including a plurality of channels, the data comparator 160 may be configured to be shared by the plurality of channels. Therefore, the data comparator 160 may read out data displayed on a previous scan line for each channel as previous data (PDATA) in sequence, and may compare the previous data and the current data (CDATA) stored in the latch 120 and provide input information regarding an over-driving operation of each channel (UP_EN_SI, DN_EN_SI) to the shift register 110 of each channel.

The source driver circuit 810 further includes an address decoding circuit 180 and a switch unit 200. The address decoding circuit 180 may store address data (ADDR) of a corresponding channel of the plurality of channels. Also, the address decoding circuit 180 provides a data read enable signal (RD_EN) to the switch unit 200. The switch unit 200 may provide the data stored in the latch 120 to the data comparator 160 as current data of a corresponding channel, based on the data read enable signal (RD_EN) provided from the address decoding circuit 180. At this time, the current data may be provided from the latch 120 to the data comparator 160 through a data bus (not shown).

The source driver circuit 810 further includes an enable signal latch 190. The enable signal lath 190 may latch the output over-driving information (UP_EN_SO, DN_EN_SO) stored in the shift register 110 by the latch enable signal (S_LAT). The output over-driving enable signal (UP_EN_SO, DN_EN_SO) stored in the enable signal latch 190 may be provided to the output buffer 150 as an ascending or descending over-driving enable signal (UP_OD_EN, DN_OD_EN), according to a result of comparing of the data comparator 160. At this time, the ascending or descending over-driving enable signal (UP_OD_EN, DN_OD_EN) may be configured to be enabled only in an on-section of the over-driving on signal (OD_ON) by the over-driving enable unit 170.

The operation of the source driver circuit 810 described above will be explained with reference to FIG. 9.

The data comparator 160 may read out display data (SFT_DATA) of a previous line provided from the shift register 110 of each channel in sequence, and may provide the display data (SFT_DATA) to the switch unit 200 using a data read enable signal (RD_EN) provided from the address decoding circuit 180. Accordingly, the data comparator 160 may compare the current data (CDATA) stored in the latch 120 and the previous data (PDATA), and may provide input information regarding over-driving (UP_EN_SI, DN_EN_SI) to the shift register 110. The shift register 110 may store the input information regarding the over-driving (UP_EN_SI, DN_EN_SI) along with the display data (SFT_DATA).

Figure 9:
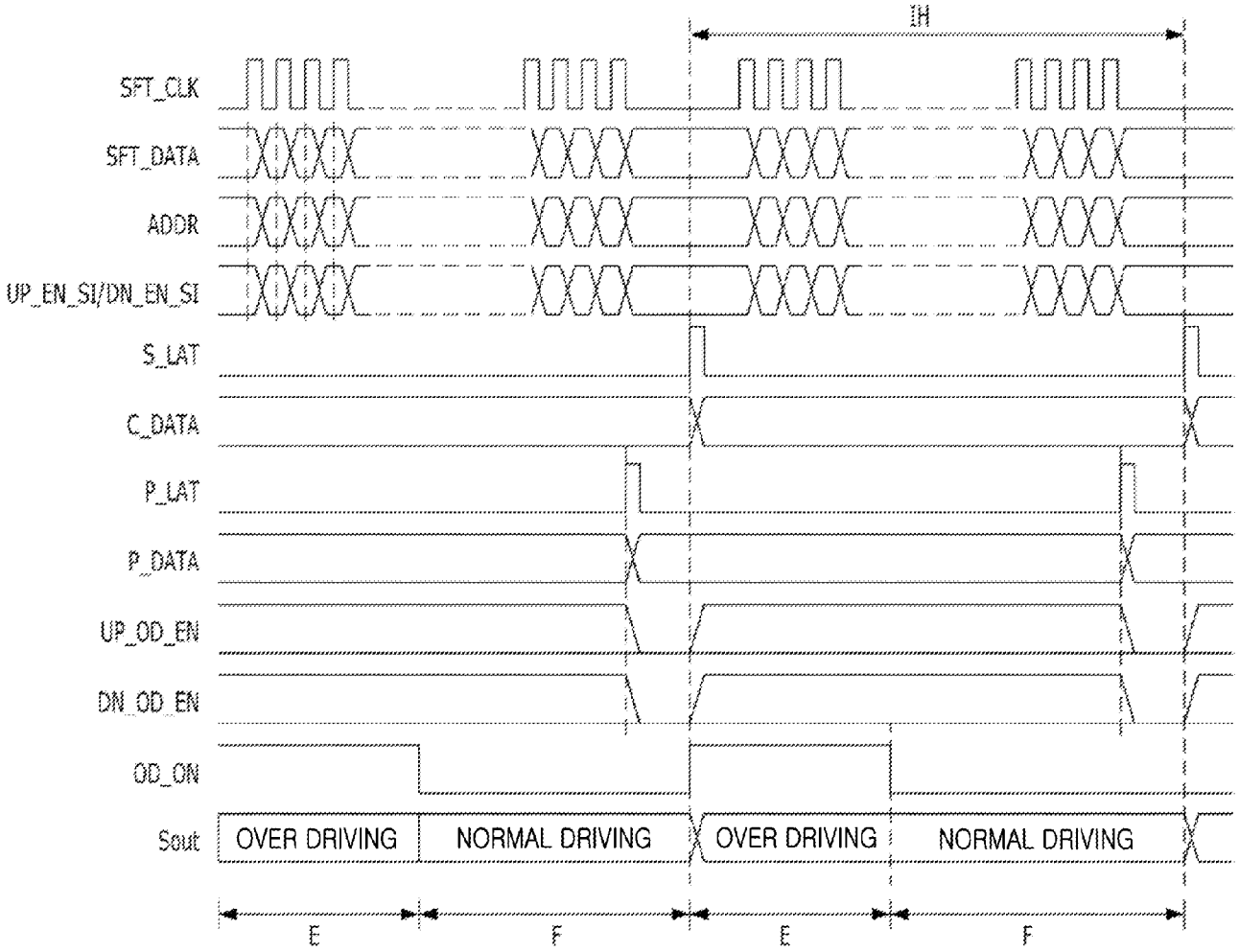
FIG. 9 is a waveform diagram illustrating the operation of the source driver circuit of FIG. 8.

The enable signal latch unit 190 of each channel may latch the output information regarding the over-driving (UP_EN_SO, DN_EN_SO) provided from the shift register 110, and may provide an ascending or descending over-driver enable signal (UP_OD_EN, DN_OD_EN) to the enable controller 170. The current data (CDATA) stored in the latch 120 may be provided to the output buffer 150, as described above. Accordingly, the output buffer 150 may perform an ascending or descending over-driving operation in an "E" section or a normal driving operation in an "F" section, according to the ascending or descending over-driver enable signal (UP_OD_EN, DN_OD_EN), as shown in FIG. 9.

In the above example embodiments, the data comparator 160 may be configured to be shared by the plurality of channels such that the circuit configuration may be simplified and the size may be reduced.

Figure 10:
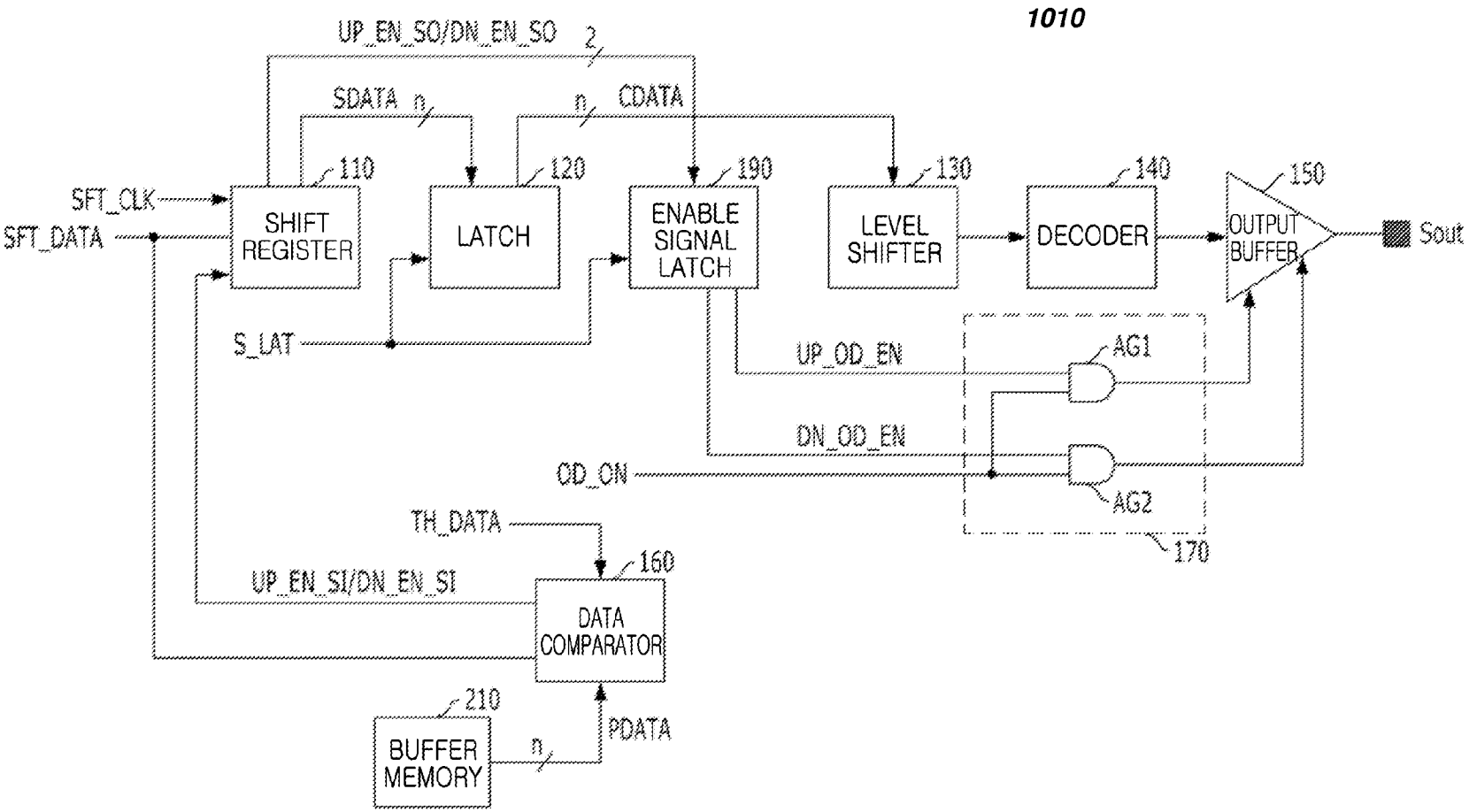
FIG. 10 is a block diagram illustrating a source driver circuit according to yet another example embodiment.

FIG. 10 is a block diagram illustrating a source driver circuit according to yet another example embodiment. Referring to FIG. 10, a source driver circuit 1010 according to yet another example embodiment includes a shift register 110, a latch 120, a level shifter 130, a decoder 140, an output buffer 150, a data comparator 160, an over-driving enable unit 170, and an enable signal latch 190. Each element may perform the same operation as described above.

The source driver circuit 1010 further includes a buffer memory 210 to store previous data of each channel. Accordingly, the data comparator 160 may read out display data (SFT_DATA) provided to the shift register 110 from each channel as current data in sequence, may compare the display data and the previous data (PDATA) provided from the buffer memory 210, and may provide information regarding over-driving (UP_EN_SI, DN_EN_SI) to the shift register 110 of each channel.

The operation of the source driver circuit 1010 will be explained with reference to FIG. 11.

The data comparator 160 may read out display data (SFT_DATA) of a current scan line provided to the shift register 110 of each channel as current data in sequence, may compare the display data (SFT_DATA) and the previous data (PDATA) provided from the buffer memory 210, and may provide input information regarding over-driving (UP_EN_SI, DN_EN_SI) to the shift register 110. The shift register 110 may stores the input information regarding the over-driving (UP_EN_SI, DN_EN_SI) along with the display data (SFT_DATA).

Figure 11:
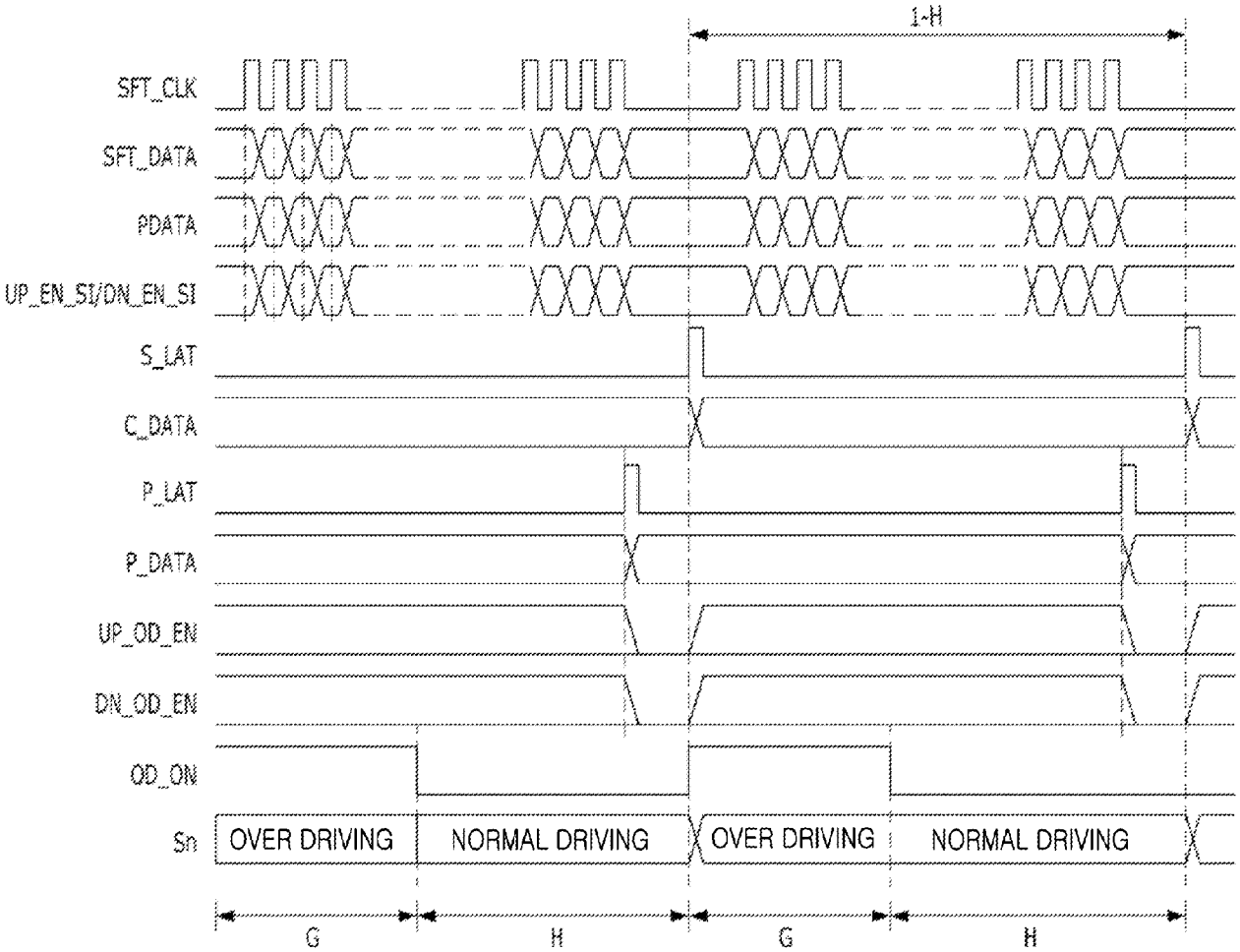
FIG. 11 is a waveform diagram illustrating the operation of the source driver circuit of FIG. 10.

If the enable signal latch 190 of each channel provides an ascending or descending over-driver enable signal (UP_OD_EN, DN_OD_EN) corresponding to the output information regarding the over-driving (UP_EN_SO, DN_EN_SO) of the shift register 110, the output buffer 150 may perform an ascending or descending over-driving operation in the "G" section or a normal driving operation in a "H" section based on the ascending or descending over-driver enable signal (UP_OD_EN, DN_OD_EN), as shown in FIG. 11.

In the above example embodiments, the data comparator 160 and the buffer memory 210 may be configured to be shared by the plurality of channels such that the circuit configuration may be simplified and the size may be reduced.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

What is claimed is:

1. An output buffer for a source driver circuit which receives an external buffer input signal and generates a buffer output signal comprising a predetermined target voltage, the output buffer comprising:

an over-driving controller configured to generate a pair of first internal buffer input signals and a pair of second internal buffer input signals for an over-driving operation, based on a first over-driver enable signal and a second over-driver enable signal, the first and second over-driver signals being provided from an external source; and an output buffer unit configured to:

perform the over-driving operation, based on the pair of first internal buffer input signals and the pair of second internal buffer input signals provided from the over-driving controller; and generate:

a buffer output signal comprising a target voltage greater than the predetermined target voltage; or a buffer output signal comprising a target voltage less than the predetermined target voltage.

2. The output buffer of claim 1, wherein the over-driving controller comprises:

a first controller configured to:

receive the external buffer input signal as a first input signal and the buffer output signal as a second input signal;

differentially amplify the first and the second input signals, based on the first and the second over-driver enable signals; and output the pair of first internal buffer input signals to the output buffer unit; and a second controller configured to:

receive the external buffer input signal as a first input signal and the buffer output signal as a second input signal;

differentially amplify the first and the second input signals based on the first and the second over-driver enable signals; and output the pair of second internal buffer input signals to the output buffer unit.

3. The output buffer of claim 2, wherein the first controller comprises:

a pair of first transistors configured to:

receive the first input signal through a gate; and output one of the pair of first internal buffer input signals to a drain; and a pair of second transistors configured to:

receive the second input signal through a gate; and output the other one of the pair of first internal buffer input signals to a drain.

4. The output buffer of claim 3, wherein the pairs of first and second transistors respectively comprise pairs of NMOS transistors.

5. The output buffer of claim 3, wherein the first controller further comprises:

a first switch connected to one of the pair of first transistors in series, the first switch configured to be controlled by the second over-driver enable signal; and a second switch connected to one of the pair of second transistors in series, the second switch configured to be controlled by the first over-driver enable signal.

6. The output buffer of claim 5, wherein the second controller comprises:

a pair of third transistors configured to:

receive the second input signal through a gate; and output one of the pair of second internal buffer input signals to a drain; and a pair of fourth transistors configured to:

receive the first input signal through a gate; and output the other one of the pair of second internal buffer input signals to a drain.

7. The output buffer of claim 6, wherein the pairs of third and fourth transistors respectively comprise pairs of PMOS transistors.

8. The output buffer of claim 6, wherein the second controller comprises:

a third switch connected to one of the pair of third transistors in series, the third switch configured to be controlled by the second over-driver enable signal; and a fourth switch connected to one of the pair of fourth transistors in series, the fourth switch configured to be controlled by the first over-driver enable signal.

9. The output buffer of claim 8, wherein, in response to the first over-driver enable signal being enabled:

the first switch is short-circuited and the second switch is open-circuited, such that a size of the pair of first transistors is smaller than a size of the pair of second transistors;

the third switch is short-circuited and the fourth switch is open-circuited, such that a size of the pair of third transistors is smaller than a size of the pair of fourth transistors; and the over-driving controller is further configured to provide the pairs of first and second internal buffer input signals for an ascending over-driving operation to the output buffer unit.

10. The output buffer of claim 8, wherein, in response to the second over-driver enable signal being enabled:

the first switch is open-circuited and the second switch is short-circuited, such that a size of the pair of first transistors is larger than a size of the pair of second transistors;

the third switch is open-circuited and the fourth switch is short-circuited, such that a size of the pair of third transistors is larger than a size of the pair of fourth transistors; and the over-driving controller is further configured to provide the pairs of first and second internal buffer input signals for a descending over-driving operation to the output buffer unit.

11. The output buffer of claim 8, wherein, in response to the first and the second over-driver enable signals being disabled:

the first and the second switches are short-circuited, such that a size of the pair of first transistors is a same as a size of the pair of second transistors;

the third and the fourth switches are short-circuited, such that a size of the pair of third transistors is a same as a size of the pair of fourth transistors; and the over-driving controller is further configured to provide the pairs of first and second internal buffer input signals for a normal driving operation to the output buffer unit.

12. The output buffer of claim 1, wherein:

the first over-driver enable signal comprises an ascending over-driver enable signal; and the second over-driver enable signal comprises a descending over-driver enable signal.

13. A source driver circuit for driving a display panel comprising a plurality of scan lines, the source driver circuit comprising:

an output buffer configured to:

receive current data to be displayed on a current scan line of the plurality of scan lines as an external buffer input signal; and provide a buffer output signal comprising a predetermined target voltage to the display panel; and a data comparator configured to:

compare the current data and previous data displayed on a previous scan line of the current scan line; and output first and second control signals to the output buffer, such that the output buffer is further configured to generate:

a buffer output signal comprising a target voltage greater than the predetermined target voltage; or a buffer output signal comprising a target voltage less than the predetermined target voltage.

14. The source driver circuit of claim 13, wherein:

the first control signal comprises an ascending over-driver enable signal; and the second control signal is a descending over-driver enable signal.

15. The source driver circuit of claim 14, wherein the data comparator is further configured to:

generate the first control signal, in response to the current data being greater than the previous data by an over-driving threshold voltage; and generate the second control signal, in response to the current data being less than the previous data by the over-driving threshold voltage.

16. The source driver circuit of claim 13, further comprising an over-driving enable unit configured to enable the first and the second control signals output from the data comparator only in an over-driving on period.

17. The source driver circuit of claim 16, wherein the over-driving enable unit comprises:

a first AND gate configured to:

receive the first control signal from the data comparator and an over-driving on signal from an external source, as two inputs; and enable the first control signal during only the over-driving on period; and a second AND gate configured to:

receive the second control signal from the data comparator and the over-driving on signal, as two inputs; and enable the second control signal during only the over-driving on period.

18. The source driver circuit of claim 13, wherein the output buffer comprises:

an over-driving controller configured to:

differentially amplify the external buffer input signal and the buffer output signal, based on the first and the second control signals provided from the data comparator; and generate a pair of first internal buffer input signals and a pair of second internal buffer input signals for an over-driving operation; and an output buffer unit configured to:

perform the over-driving operation, based on the pairs of first and second internal buffer input signals; and generate:

a buffer output signal comprising a target voltage greater than the predetermined target voltage; or a buffer output signal comprising a target voltage less than the predetermined target voltage.

19. The source driver of claim 18, wherein the over-driving controller comprises:

a pair of first differential transistors configured to:

receive the external buffer input signal through each respective gate; and output one of the pair of first internal buffer input signals to the output buffer unit through a drain;

a pair of second differential transistors configured to:

receive the buffer output signal through each respective gate; and output another of the pair of first internal buffer input signals to the output buffer unit through a drain;

a pair of third differential transistors configured to:

receive the external buffer input signal through each respective gate; and output one of the pair of second internal buffer input signals to the output buffer unit through a drain;

a pair of fourth differential transistors configured to:

receive the buffer output signal through each respective gate; and output another of the pair of second internal buffer input signals to the output buffer unit through a drain;

a pair of first switches respectively connected to one of the pair of first differential transistors and one of the pair of second differential transistors in series, the pair of first switches configured to be respectively controlled by the first and the second control signals; and a pair of second switches respectively connected to one of the pair of third differential transistors and one of the pair of fourth differential transistors in series, the pair of second switches configured to be respectively controlled by the first and the second control signals.

20. The source driver circuit of claim 13, wherein, in response to the source driver circuit comprising a plurality of channels:

the output buffer is provided in each of the plurality of channels; and the data comparator is provided in each of the plurality of channels or is configured to be shared by the plurality of channels.

21. A source driver circuit for driving a display panel comprising a plurality of scan lines, the source driver circuit comprising:

a latch configured to store:

current data to be displayed on a current scan line of the plurality of scan lines; and previous data displayed on a previous scan line of the current scan line;

a data comparator configured to:

compare the current data and the previous data provided from the latch; and generate an ascending over-driver enable signal or a descending over-driver enable signal, in response to the current data being greater than or less than the previous data by an over-driving threshold data; and an output buffer configured to:

perform an over-driving operation based on the ascending or descending over-driver enable signal; and provide:

a buffer output signal comprising a target voltage greater than a predetermined target voltage with respect to the current data, which is an external buffer input signal; or a buffer output signal comprising a target voltage less than the predetermined target voltage to the display panel.

22. The source driver circuit of claim 21, wherein the latch comprises:

a first latch unit configured to store the current data; and a second latch unit configured to store the previous data.

23. The source driver circuit of claim 22, wherein, in response to the current data stored in the first latch unit being provided to the data comparator, the current data:

is stored in the second latch unit; and is used as previous data for a next scan line right of the current scan line.

24. The source driver circuit of claim 23, further comprising:

a shift register configured to:

shift display data provided from an external source by a shift register clock signal; and store the display data in the first latch unit as current data;

a level shifter configured to level-shift the current data provided from the first latch unit; and a decoder configured to:

convert the current data which is level-shifted by the level shifter into analog data, based on a gray-scale voltage; and provide the analog data to the output buffer.

25. The source driver circuit of claim 21, wherein:

the source driver circuit comprises a plurality of channels; and the data comparator is provided in each channel.

26. The source driver circuit of claim 21, wherein the output buffer comprises:

pairs of first and second NMOS transistors configured to:

receive the external buffer input signal and the buffer output signal through each gate; and generate a pair of first internal buffer input signals;

pairs of first and second PMOS transistors configured to:
receive the external buffer input signal and the buffer output signal through each gate; and
generate a pair of second internal buffer input signals;
a pair of first switches respectively connected to one of the pair of first NMOS transistors and one of the pair of second NMOS transistors, the pair of first switches configured to be respectively controlled by the descending and the ascending over-driver enable signals;
a pair of second switches respectively connected to one of the pair of first PMOS transistors and one of the pair of second PMOS transistors, the pair of first switches configured to be respectively controlled by the descending and the ascending over-driver enable signals; and
an output buffer unit configured to:
perform an over-driving operation, based on the pairs of first and second internal buffer input signals; and
provide the output buffer signal comprising a target voltage greater than or less than the predetermined target voltage to the display panel.

27. A source driver circuit comprising a plurality of channels, for driving a display panel comprising a plurality of scan lines, the source driver circuit comprising:
a latch configured to latch data for a current scan line using a latch enable signal;
a data comparator configured to:
read out display data of a previous scan line of the current scan line for each channel as previous data in sequence;
compare the current data provided from the latch and the previous data; and
generate over-driving information for each channel;
a shift register configured to store the display data as the current data and the over-driving information;
an enable signal latch configured to provide an ascending or a descending over-driver enable signal, based on the over-driving information provided from the shift register; and
an output buffer configured to:
perform an over-driving operation based on the ascending or descending over-driver enable signal, and
provide:
a buffer output signal comprising a target voltage greater than a predetermined target voltage with respect to the current data, which is an external buffer input signal; or
a buffer output signal comprising a target voltage less than the predetermined target voltage to the display panel.

28. The source driver circuit of claim 27, further comprising:
an address decoding circuit configured to generate a data read enable signal, using the latch enable signal, based on an address signal of each channel; and
a switch unit configured to provide current data of each channel to the data comparator, based on the data read enable signal.

29. The source driver circuit of claim 27, wherein the output buffer comprises:
pairs of first and second NMOS transistors configured to:
receive the external buffer input signal and the buffer output signal through each gate; and
generate a pair of first internal buffer input signals;
pairs of first and second PMOS transistors configured to:
receive the external buffer input signal and the buffer output signal through each gate; and
generate a pair of second internal buffer input signals;
a pair of first switches respectively connected to one of the pair of first NMOS transistors and one of the pair of second NMOS transistors, the pair of first switches configured to be respectively controlled by the ascending and the descending over-driver enable signals;
a pair of second switches respectively connected to one of the pair of first PMOS transistors and one of the pair of second PMOS transistors, the pair of second switches configured to be respectively controlled by the descending and the ascending over-driver enable signals; and
an output buffer unit configured to:
perform an over-driving operation, based on the pairs of first and second internal buffer input signals; and
provide the output buffer signal comprising a target voltage greater than or less than the predetermined target voltage to the display panel.

30. The source driver circuit of claim 27, wherein the data comparator is further configured to be shared by the plurality of channels.

31. A source driver circuit comprising a plurality of channels, for driving a display panel comprising a plurality of scan lines, the source driver circuit comprising:
a buffer memory configured to store previous data for a previous scan line of each channel;
a latch configured to latch display data of a next scan line of the previous scan line as current data;
a data comparator configured to:
read out previous data of each channel from a buffer memory in sequence;
compare the current data provided from the latch and the previous data; and
generate over-driving information for each channel;
a shift register configured to store the display data and the over-driving information;
an enable signal latch configured to provide an ascending or descending over-driver enable signal, based on the over-driving information provided from the shift register; and
an output buffer configured to:
perform an over-driving operation based on the ascending or descending over-driver enable signal; and
provide:
a buffer output signal comprising a target voltage greater than a predetermined target voltage with respect to the current data, which is an external buffer input signal; or
a buffer output signal comprising a target voltage less than the predetermined target voltage to the display panel.

32. The source driver circuit of claim 31, further comprising:
an address decoding circuit configured to generate a read enable signal using the latch enable signal, based on an address signal of each channel; and
a switch unit configured to provide the current data of each channel to the data comparator, based on the data read enable signal.

33. The source driver circuit of claim 31, wherein the output buffer comprises:
pairs of first and second NMOS transistors configured to:
receive the external buffer input signal and the buffer output signal through each gate; and
generate a pair of first internal buffer input signals;
pairs of first and second PMOS transistors configured to:
receive the external buffer input signal and the buffer output signal through each gate; and generate a pair of second internal buffer input signals;

a pair of first switches respectively connected to one of the pair of first NMOS transistors and one of the pair of second NMOS transistors, the pair of first switches configured to be respectively controlled by the ascending and the descending over-driver enable signals;

a pair of second switches respectively connected to one of the pair of first PMOS transistors and one of the pair of second PMOS transistors, the pair of second switches configured to be respectively controlled by the ascending and the descending over-driver enable signals; and an output buffer unit configured to:

perform an over-driving operation based on the pairs of first and second internal buffer input signals; and provide the output buffer signal comprising a target voltage greater than or less than the predetermined target voltage to the display panel.

34. The source driver circuit of claim 31, wherein the data comparator and the buffer memory are configured to be shared by the plurality of channels.

35. A method of implementing an output buffer for a source driver circuit which receives an external buffer input signal and generates a buffer output signal including a predetermined target voltage, the method comprising:

generating, by an over-driving controller, a pair of first internal buffer input signals and a pair of second internal buffer input signals for an over-driving operation, based on a first over-driver enable signal and a second over-driver enable signal, the first and second over-driver signals being provided from an external source;

performing, by an output buffer unit, the over-driving operation, based on the pair of first internal buffer input signals and the pair of second internal buffer input signals provided from the over-driving controller; and generating, by the output buffer unit:

a buffer output signal comprising a target voltage greater than the predetermined target voltage; or a buffer output signal comprising a target voltage less than the predetermined target voltage.

36. The method of claim 35, further comprising:

receiving, by a first controller, the external buffer input signal as a first input signal and the buffer output signal as a second input signal;

differentially amplifying, by the first controller, the first and the second input signals, based on the first and the second over-driver enable signals;

outputting, by the first controller, the pair of first internal buffer input signals to the output buffer unit;

receiving, by a second controller, the external buffer input signal as a first input signal and the buffer output signal as a second input signal;

differentially amplifying, by the second controller, the first and the second input signals based on the first and the second over-driver enable signals; and outputting, by the second controller, the pair of second internal buffer input signals to the output buffer unit.

37. The method of claim 36, further comprising:

receiving, by a pair of first transistors, the first input signal through a gate;

outputting, by the pair of first transistors, one of the pair of first internal buffer input signals to a drain;

receiving, by a pair of second transistors, the second input signal through a gate; and outputting, by the pair of second transistors, the other one of the pair of first internal buffer input signals to a drain.

38. The method of claim 37, wherein the first controller further comprises:

a first switch connected to one of the pair of first transistors in series and controlled by the second over-driver enable signal; and a second switch connected to one of the pair of second transistors in series and controlled by the first over-driver enable signal.

39. The method of claim 38, further comprising:

receiving, by a pair of third transistors, the second input signal through a gate;

outputting, by the pair of third transistors, one of the pair of second internal buffer input signals to a drain;

receiving, by a pair of fourth transistors, the first input signal through a gate; and outputting, by the pair of fourth transistors, the other one of the pair of second internal buffer input signals to a drain.

40. The method of claim 39, wherein the second controller comprises:

a third switch connected to one of the pair of third transistors in series and controlled by the second over-driver enable signal; and a fourth switch connected to one of the pair of fourth transistors in series and controlled by the first over-driver enable signal.

41. The method of claim 40, further comprising, in response to the first over-driver enable signal being enabled:

closing the first switch and opening the second switch, such that a size of the pair of first transistors is smaller than a size of the pair of second transistors;

closing the third switch and opening the fourth switch, such that a size of the pair of third transistors is smaller than a size of the pair of fourth transistors; and providing, by the over-driving controller, the pairs of first and second internal buffer input signals for an ascending over-driving operation to the output buffer unit.

42. The method of claim 40, further comprising, in response to the second over-driver enable signal being enabled:

opening the first switch and closing the second switch, such that a size of the pair of first transistors is larger than a size of the pair of second transistors;

opening the third switch and closing the fourth switch, such that a size of the pair of third transistors is larger than a size of the pair of fourth transistors; and providing, by the over-driving controller, the pairs of first and second internal buffer input signals for a descending over-driving operation to the output buffer unit.

43. The method of claim 40, further comprising, in response to the first and the second over-driver enable signals being disabled:

closing the first and the second switches, such that a size of the pair of first transistors is a same as a size of the pair of second transistors;

closing the third and the fourth switch, such that a size of the pair of third transistors is a same as a size of the pair of fourth transistors; and providing, by the over-driving controller, the pairs of first and second internal buffer input signals for a normal driving operation to the output buffer unit.

44. A method of implementing a source driver circuit for driving a display panel including a plurality of scan lines, the method comprising:

receiving, by an output buffer, current data to be displayed on a current scan line of the plurality of scan lines as an external buffer input signal;

providing, by the output buffer, a buffer output signal comprising a predetermined target voltage to the display panel;

compare, by a data comparator, the current data and previous data displayed on a previous scan line of the current scan line; and output, by the data comparator, first and second control signals to the output buffer, such that the output buffer generates:

a buffer output signal comprising a target voltage greater than the predetermined target voltage; or a buffer output signal comprising a target voltage less than the predetermined target voltage.

45. A method of implementing a source driver circuit for driving a display panel including a plurality of scan lines, the method comprising:

storing, by a latch:

current data to be displayed on a current scan line of the plurality of scan lines; and previous data displayed on a previous scan line of the current scan line;

comparing, by a data comparator, the current data and the previous data provided from the latch;

generating, by the data comparator, an ascending over-driver enable signal or a descending over-driver enable signal, in response to the current data being greater than or less than the previous data by an over-driving threshold data;

performing, by an output buffer, an over-driving operation based on the ascending or descending over-driver enable signal; and providing, by the output buffer:

a buffer output signal comprising a target voltage greater than a predetermined target voltage with respect to the current data, which is an external buffer input signal; or a buffer output signal comprising a target voltage less than the predetermined target voltage to the display panel.

46. A method of implementing a source driver circuit including a plurality of channels, for driving a display panel including a plurality of scan lines, the method comprising:

latching data, by a latch, for a current scan line using a latch enable signal;

reading out, by a data comparator, display data of a previous scan line of the current scan line for each channel as previous data in sequence, comparing, by the data comparator, the current data provided from the latch and the previous data, and generating, by the data comparator, over-driving information for each channel;

storing, by a shift register, the display data as the current data and the over-driving information;

providing, by an enable signal latch, an ascending or a descending over-driver enable signal, based on the over-driving information provided from the shift register;

performing, by an output buffer, an over-driving operation based on the ascending or descending over-driver enable signal, and providing, by the output buffer:

a buffer output signal comprising a target voltage greater than a predetermined target voltage with respect to the current data, which is an external buffer input signal; or a buffer output signal comprising a target voltage less than the predetermined target voltage to the display panel.

47. A method of implementing a source driver circuit which includes a plurality of channels, for driving a display panel including a plurality of scan lines, the method comprising:

storing, by a buffer memory, previous data for a previous scan line of each channel;

latching, by a latch, display data of a next scan line of the previous scan line as current data;

reading out, by a data comparator, previous data of each channel from a buffer memory in sequence;

comparing, by the data comparator, the current data provided from the latch and the previous data;

generating, by the data comparator, over-driving information for each channel;

storing, by a shift register, the display data and the over-driving information;

providing, by an enable signal latch, an ascending or descending over-driver enable signal, based on the over-driving information provided from the shift register;

performing, by an output buffer, an over-driving operation based on the ascending or descending over-driver enable signal; and providing, by the output buffer:

a buffer output signal comprising a target voltage greater than a predetermined target voltage with respect to the current data, which is an external buffer input signal; or a buffer output signal comprising a target voltage less than the predetermined target voltage to the display panel.

* * * * *